US011247820B2

(12) United States Patent
Bates

(10) Patent No.: US 11,247,820 B2
(45) Date of Patent: Feb. 15, 2022

(54) CONTAINER CARRIERS

(71) Applicant: British Polythene Limited, Rushden (GB)

(72) Inventor: Stephen Bates, Reading (GB)

(73) Assignee: British Polythene Limited, Rushden (GB)

( * ) Notice: Subject to any disclaimer, the term of this patent is extended or adjusted under 35 U.S.C. 154(b) by 0 days.

(21) Appl. No.: 17/045,169

(22) PCT Filed: Apr. 4, 2019

(86) PCT No.: PCT/GB2019/050978
§ 371 (c)(1),
(2) Date: Oct. 4, 2020

(87) PCT Pub. No.: WO2019/193344
PCT Pub. Date: Oct. 10, 2019

(65) Prior Publication Data

US 2021/0221589 A1 Jul. 22, 2021

(30) Foreign Application Priority Data

Apr. 5, 2018 (GB) ..... 1805581
Jun. 19, 2018 (GB) ..... 1810040

(51) Int. Cl.
*B65D 71/50* (2006.01)
*B65B 17/02* (2006.01)

(52) U.S. Cl.
CPC ..... *B65D 71/504* (2013.01); *B65B 17/025* (2013.01); *B65D 2571/0045* (2013.01); *B65D 2571/00456* (2013.01)

(58) Field of Classification Search
CPC ..... B65D 71/50; B65D 71/504; B65D 75/00; B65D 2571/0045; B65D 2571/00456; B65D 71/00; B65D 71/02; B65D 85/66; B65B 27/04
USPC ..... 206/150–151; 294/87.2
See application file for complete search history.

(56) References Cited

U.S. PATENT DOCUMENTS 3,044,230 A * 7/1962 Fisher ..... B65D 71/504 53/398
3,285,410 A 11/1966 Brunsing
3,383,827 A * 5/1968 Schaich ..... B65B 17/025 53/398
3,385,626 A * 5/1968 Wozniak ..... B65D 71/504 294/87.2
3,627,123 A * 12/1971 Wachter ..... B65D 71/504 206/150
3,946,535 A 3/1976 Bourgeois
(Continued)

FOREIGN PATENT DOCUMENTS

CN 1065435 A 10/1992
CN 1150107 A 5/1997
(Continued)

*Primary Examiner* — Bryon P Gehman
(74) *Attorney, Agent, or Firm* — Lightbulb IP, LLC

(57) ABSTRACT

A carrier having a plurality of apertures for holding a plurality of containers together is provided. The carrier has mutually spaced drive pins holes distributed longitudinally therealong. Each container aperture is positioned longitudinally between drive pin holes and each aperture has a centre which is longitudinally offset from a mid-point between successive drive pin holes.

14 Claims, 23 Drawing Sheets

(56) References Cited

U.S. PATENT DOCUMENTS

| | | | | |
|---|---|---|---|---|
| 3,966,044 | A * | 6/1976 | Cunningham | B65D 71/504 206/427 |
| 4,592,466 | A * | 6/1986 | Walters | B65D 71/504 206/150 |
| 5,267,427 | A | 12/1993 | Peterson | |
| 7,510,074 | B2 * | 3/2009 | Weaver | B65D 71/504 206/150 |
| 9,079,700 | B2 * | 7/2015 | Marco | B65D 23/102 |
| 9,815,605 | B2 * | 11/2017 | Bates | B65B 17/025 |
| 10,913,560 | B2 * | 2/2021 | Ludwig | B65B 27/04 |
| 2010/0140121 | A1 | 6/2010 | Slaters | |
| 2013/0263557 | A1 | 10/2013 | Bates | |
| 2015/0197357 | A1 | 7/2015 | Ludwig | |
| 2017/0190488 | A1 | 7/2017 | Bates | |

FOREIGN PATENT DOCUMENTS

| | | | |
|---|---|---|---|
| CN | 1182034 | A | 5/1998 |
| CN | 1249265 | A | 4/2000 |
| CN | 1345685 | A | 4/2002 |
| CN | 1557684 | A | 12/2004 |
| CN | 1938199 | A | 3/2007 |
| CN | 1960922 | A | 5/2007 |
| CN | 101784460 | A | 7/2010 |
| CN | 102648135 | A | 8/2012 |
| CN | 103221309 | A | 7/2013 |
| CN | 104010760 | A | 8/2014 |
| CN | 106660645 | A | 5/2017 |
| EP | 2504251 | A1 | 10/2012 |
| EP | 2504251 | B1 | 8/2015 |
| GB | 2475622 | A | 5/2011 |
| WO | WO 2015061196 | A1 | 4/2015 |

* cited by examiner

Figure I

CONTAINER CARRIERS

The present invention relates generally to a container carrier, particularly to a plastics container carrier for securely retaining containers together, to a machine and system for applying container carriers to containers.

It is well known to package containers together using a carrier. Such carriers (sometimes referred to as "carrier stock") are often formed from a plastics film with a plurality of apertures, for example as described in U.S. Pat. Nos. 2,874,835, 4,250,682 and 2,936,070. These carriers are normally applied to containers by first stretching the apertures. More recently an alternative method of application has been described in WO2011/061518 in which carrier stock is rolled onto containers and the geometry of the apertures is such that pre-stretching is not required.

In many existing systems, particularly for "side applied" carriers, where the carrier must travel down to the side of a container, it is necessary for the containers to be mechanically raised at the point of application to prevent fouling on the subsequent container in a continuous line.

The present invention seeks to address problems with known carrier stock.

An aspect of the present invention provides a carrier having a plurality of apertures for holding a plurality of containers together, the carrier having mutually spaced drive pins holes distributed longitudinally therealong, each aperture is positioned longitudinally between drive pin holes, each aperture has a centre which is longitudinally offset from a mid-point between successive drive pin holes.

In a further aspect the present invention provides a plastics film having a plurality of apertures for holding a plurality of containers together, the film having mutually spaced drive pins holes distributed longitudinally along the film, each aperture is positioned longitudinally between drive pin holes, each aperture has a centre which is longitudinally offset from a mid-point between successive drive pin holes.

The relationship between the centre point of an aperture and a mid-point between drive pin holes is such that they are not longitudinally aligned. Rather there is a longitudinal offset between these points. By offsetting the aperture from the drive pin hole-to-hole midpoint dimension this means that if a carrier stock formed from such a film is rolled onto containers, the previous container does not interfere with positioning the aperture about the next container.

In some ways, therefore, the present invention may relate to the relationship between the leading edge of the aperture and the drive pin/s; for example being shifted towards a rear/trailing drive pin. The apertures are therefore shifted relative to the pin positions. In some respects this may be thought of as the apertures being out of phase with the drive pins.

The centre point of the apertures would normally be the centre point between two drive pins. The datum is the pin position and the shift occurs relative to that datum point, for example being offset "backwards".

The carrier/film may have a leading drive pin hole and a trailing drive pin hole associated with each aperture, the holes being longitudinally spaced along the carrier/film, in which each aperture centre is longitudinally offset towards the leading drive pin hole or the trailing drive pin hole.

The aperture centres may be longitudinally offset towards their respective trailing drive pin hole.

The aperture centres may be longitudinally offset towards their respective leading drive pin hole.

In some embodiments, therefore, an "offset aperture" principle is used. In some embodiments the direction of an application drum is clockwise and the containers move from right to left (relative terms are only used to improve clarity and are not intended to be limiting). This means that the leading drive pin (i.e. the pin first engaged by the drum) for the aperture is to the left and the trailing drive pin is to the right. This also means that the leading edge of the aperture (i.e. the edge that first passes over and down onto the container) is to the left and the trailing edge of the aperture is to the right. The centreline of the aperture is shifted towards the trailing pin (i.e. to the right).

In use this means that as the carrier is clockwise rotated/rolled down onto a container (with the container moving on a conveyor from right to left) the trailing edge is less likely to foul on the top of the container before it starts to "wipe" down the side of the container.

A curved edge of the aperture may be provided on the trailing edge, which is also the direction in which the aperture is offset.

In some embodiments the carrier/film comprises two (or more) parallel rows of apertures.

The carrier/film may have a centreline between rows and the aperture centres may be offset towards the centreline.

In some embodiments, between the rows are provided one or more manipulation apertures and/or weight saving cut-outs. For example alternating generally oval-shape and generally polygonal shape cut-outs may be provided.

The apertures may be generally polygonal, for example square, rectangular or diamond shaped.

In some embodiments the apertures are generally rectangular. The apertures may be oriented with the longer dimension extending longitudinally along the carrier/film.

Each aperture may have a geometry comprising one or more tabs facing the centre. The or each tab may be defined by arcuate cut-outs, for example positioned in the corners of apertures.

In some embodiments each aperture has only one tab, for example defined by two truncated circular or arcuate cut-outs, one at either side thereof.

The or a tab may be positioned towards the trailing drive pin hole side of the aperture.

The carrier/film may comprise a longitudinal slot or slit extending laterally of each aperture.

The carrier/film may comprise a transverse slot or slit extending between apertures.

In some embodiments the carrier is a film formed from a plastics material, for example a non-stretch film (i.e. there is substantially no stretching of the film during the application process).

In some embodiments the film is formed from a non-oil-based plastics material.

In some embodiments the film is formed from a carbon capture plastics material.

In some embodiments the film is formed at least partly from recycled plastics material.

The carrier/film may, for example, be made from a polyethylene or polyethylene derivatives; for example the film may be formed from LDPE.

Different materials, including paper, cardboard, cornstarch or potato starch, may be used to form generally flat, planar carriers.

In some embodiments carriers are formed by rotary die cutting; in other embodiments punch cutting is used, for example. Other methods of manufacture, including additive manufacturing, may be used.

In some embodiments a carrier may be formed so as to have no straight transverse cuts. This may be particularly useful where die cutting is used. Non-straight cuts allow for a slicing action in the die cutting process, improving die wear.

A handle portion may be provided. The handle may, for example, extend from one side of a length of film. The handle may be formed integrally or be a separate part that is attached or attachable to a carrier.

In some embodiments one or more panels, such as a merchandising panel, may be provided and extend along at least part of the length of one or more sides/edges of the carrier.

The aperture centres may be offset from the midpoint of the driving pin holes by an amount in the range 2% to 50%. Put another way, the ratio may be in the range 1/50 to 1/2.

The amount of the offset may be defined as being a maximum of half the length of the unapplied aperture.

Examples of offset amounts include, for example, 1 mm, 2 mm, 3 mm, 4 mm or 5 mm or more. In some embodiments, for example, the offset is up to 75 mm.

In some embodiments a single drive pin hole is provided for each aperture. In other embodiments a leading and trailing pin is provided for each aperture. Additional drive pin holes may also be provided where appropriate.

The driving pin holes may be provided towards a longitudinal edge of the carrier/film.

The carrier/film may be adapted to be rolled onto containers.

The carrier/film may be adapted to be applied with unstretched apertures. In other words, no pre-stretching or manipulation of the apertures is required. Stretching of the apertures may result during application.

Driving pin holes may be provided in the region of the pitch of a container.

The carrier/film may form a three-dimensional structure when applied.

The carrier/film may be provided as a continuous roll.

The carrier/film may be configured to be divisible between a leading drive pin hole of one aperture and a trailing drive pin hole of the longitudinally adjacent aperture.

The carrier/film may be configured to be divisible through a single drive pin hole of the longitudinally adjacent aperture.

In some embodiments the carrier/film has a length of single-rank apertures. In other embodiments a length of multi-rank apertures is provided.

The apertures may be dimensioned to fit around the sidewall of a container.

In some embodiments the apertures are dimensioned to fit around the neck of a bottle.

The apertures may be dimensioned to fit under or in or on a rim, undercut, chime or channel formed on a container.

The present invention also provides a container carrier comprising a length of film as described herein.

The present invention also provides a multipack bottle carrier comprising a carrier/length of film as described herein.

The present invention also provides a multipack bottle carrier for machine application to substantially identical bottles, comprising a carrier/film as described/defined herein.

In some embodiments the carrier is a film. The terms "carrier" and "film" may, therefore, be used interchangeably where appropriate.

The present invention also provides a side-applied multipack bottle carrier comprising a carrier/film as described herein with apertures configured to fit tightly around a relief formed in a bottle sidewall.

The present invention also provides a multi-container pack comprising a plurality of containers held together by carrier/film as described herein.

The present invention also provides a method of side applying unitising container carriers to containers, comprising the steps of:

providing an application station comprising a roller drum for applying a carrier to containers, providing a conveyor system for transporting containers and feeding them at a generally constant speed, and a generally constant height, to and through the application station, providing carriers having a number of apertures for holding a number of containers, the roller drum in use receiving carriers from a supply system and urging them onto and down the side of the containers without pre-stretching of the apertures.

The present invention also provides a method of side applying unitising container carriers to containers, comprising the steps of:

providing an application station comprising a roller drum for applying a carrier to containers, providing a conveyor system for transporting containers and feeding them at a generally constant speed, and a generally constant height, to and through the application station, providing carriers comprising a plastic sheet material having a number of apertures for holding a number of containers, the roller drum in use receiving carriers from a supply system and urging them onto and down the side of the containers without pre-stretching of the apertures.

When comparing "side application" with "rim application" one significant difference is, of course, how far down the side of a container the carrier travels. One way of achieving this in accordance with the present invention is by using a drum with a significantly larger diameter than used for rim application. In some embodiments, for example, a drum with a diameter in the range 1400 mm to 1800 mm may be used, for example a diameter of approximately 1600 mm. This allows the carriers to be pushed further down.

The containers may "enter" the circumference of the drum i.e. they enter into the drum during application. This allows the carriers to be pushed down. In some embodiments the containers "penetrate" the drum circumference by at least 20 mm.

The containers (such as cans or bottles) can be fed in continuously at a constant speed, and can be in contact with each other.

There is substantially no change in the height/level of the containers along the conveyor. This means that adjacent containers do not rub against each other when compared to known systems requiring containers to be raised at the point of application (to allow the carrier to be moved down the side thereof). This helps to prevent damage to the container and/or associated labels/stickers. A further advantage of the use of the offset aperture is that the diameter of the application drum can be smaller than on systems utilising no offset. As the containers are fed into the application drum the position of the container aperture in the carrier is in a higher circumferential position, therefore avoiding fouling the top of the container, during the infeed/rotation interaction of the container and drum. This is normally achieved by the use of a larger diameter drum which has a shallower angle of incidence to the containers as a result of the greater circumference. In some embodiments, for example, this allows for the use of a 60-pitch drum, where a 72-pitch drum would be required.

The present invention also provides a machine for side applying unitising container carriers to containers, the machine comprising:

an application station comprising a roller drum for applying a carrier to containers, a conveyor system for transporting containers and feeding them at a generally constant speed, and a generally constant height, to and through the application station, a supply system for providing carriers having a number of apertures for holding a number of containers, the roller drum in use receiving carriers from the supply system and urging them onto and down the side of the containers without pre-stretching of the apertures.

The present invention also provides a machine for side applying unitising container carriers to containers, the machine comprising:

an application station comprising a roller drum for applying a carrier to containers, a conveyor system for transporting containers and feeding them at a generally constant speed, and a generally constant height, to and through the application station, a supply system for providing carriers comprising a plastic sheet material having a number of apertures for holding a number of containers, the roller drum in use receiving carriers from the supply system and urging them onto and down the side of the containers without pre-stretching of the apertures.

The conveyor system may include a caterpillar drive for timing the position of containers with respect to the roller drum. The caterpillar drive may engage the sides of the containers and allows the position of the containers to be known in relation to the apertures of a waiting carrier. The movement of the containers can thereby be coincided with rotation of the application drum. In addition the caterpillar drive can be used to hold the containers in position as they pass into and through the application station.

In some embodiments the carriers may also be separated at the application station. For example the roller drum may comprise cutting blades for separating carriers. In embodiments with a caterpillar drive or the like the drive can also be used to hold the containers as the carrier is separated from the trailing carrier in a continuous stream.

In some embodiments the cut is offset, in other words the cut occurs post application and in some embodiments the trailing carrier is already at least partially engaged with trailing containers; this means the cut occurs between two engaged containers. In some embodiments the cut is generally parallel to the sides of the container i.e. the cut is "straight down". The cut may therefore be beyond bottom dead centre. Cutting blades may radiate radially but not from the centre of the drum.

The roller drum may urge the carrier down to a point on the side of a container (measured down from the top) in the range 20 to 55%, 20 to 50% or 30 to 40% of the height of the container, for example at least about 20% or at least about 30% of the height of the containers. In some embodiments the carriers are pushed approximately half way down the container.

The carrier used in methods and/or machines formed in accordance with the present invention may be a carrier/film as described/defined herein. The offset aperture centre/drive pin principle helps prevent the drum fouling on trailing containers, particularly when side applied.

The present invention also provides a machine for side applying unitising container carriers to containers, the machine comprising:

an application station comprising a roller drum for applying a carrier to containers, a conveyor system for transporting containers and feeding them to and through the application station, the conveyor system includes a caterpillar drive for engaging the sides of containers and defining their position on the conveyor during application, a supply system for providing carriers having a number of apertures for holding a number of containers.

The present invention also provides a machine for side applying unitising container carriers to containers, the machine comprising:

an application station comprising a roller drum for applying a carrier to containers, a conveyor system for transporting containers and feeding them to and through the application station, the conveyor system includes a caterpillar drive for engaging the sides of containers and defining their position on the conveyor during application, a supply system for providing carriers comprising a plastic sheet material having a number of apertures for holding a number of containers.

In some embodiments, therefore, the present invention provides a method/system of holding containers (such as bottles, cans or jars) around their sidewall substantially without any significant pre-stretching of the material of the carrier.

The present invention also provides a machine for continuously applying unitising container carriers to containers, the machine comprising:

an application station comprising a roller drum for applying carriers to containers, a conveyor system for transporting containers and feeding them to and through the application station, a supply system for providing carriers to the application station, the carriers being provided as a continuous length, the roller drum comprising means for applying carriers to containers and also for separating carriers.

Different aspects and embodiments can be used together or separately.

The present invention will now be more particularly described, by way of example, with reference to the accompanying drawings, in which.

Example embodiments are described in sufficient detail to enable those of ordinary skill in the art to embody and implement the systems and processes herein described. It is important to understand that embodiments can be provided in many alternate forms and should not be construed as limited to the examples set forth herein.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Figure 1:
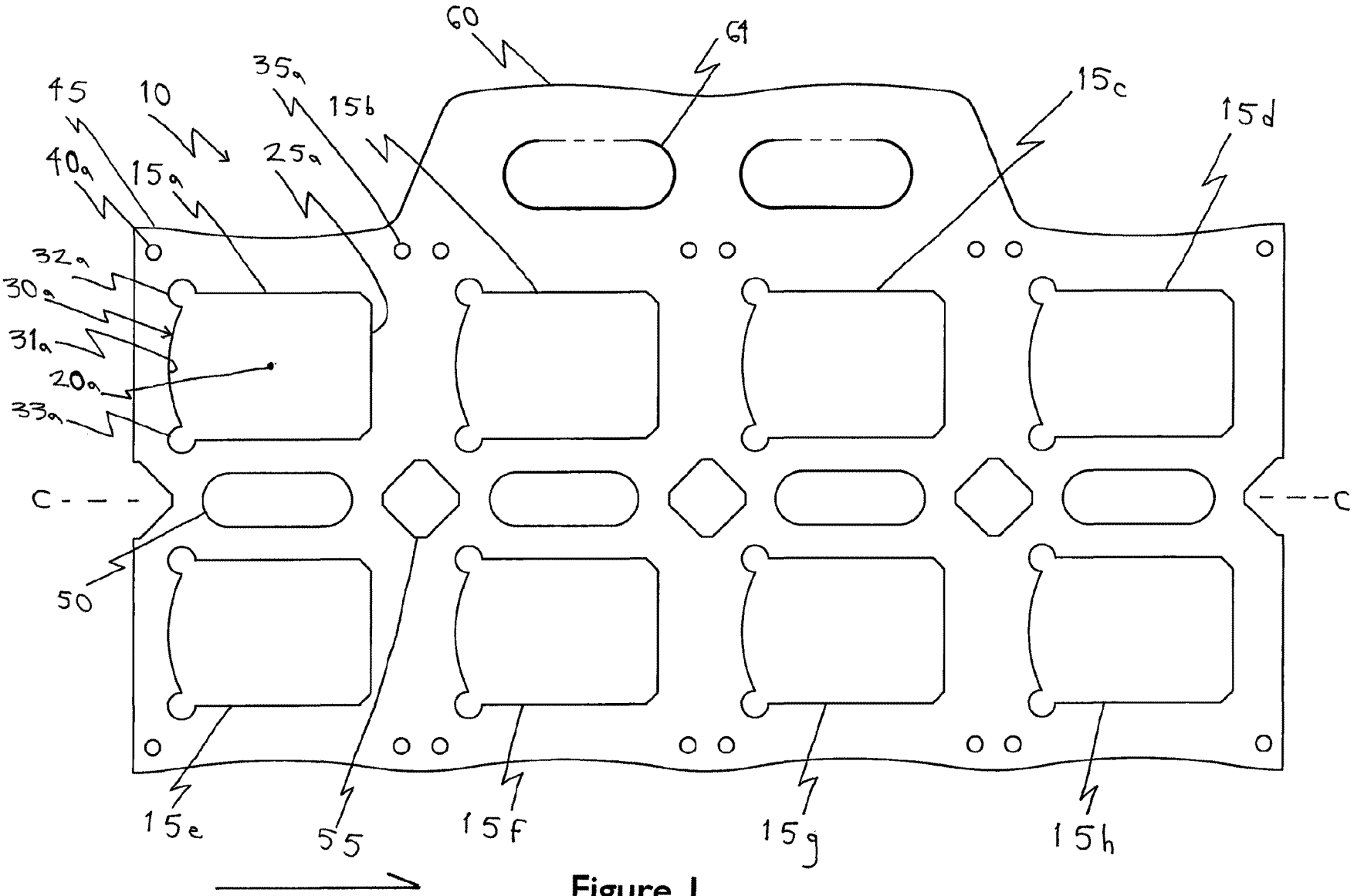
FIG. 1 illustrates a container carrier stock generally indicated.

Referring first to FIG. 1 there is shown a container carrier stock generally indicated 10. The carrier 10 is generally rectangular in plan and formed from a sheet of polyethylene. The direction of application in use is indicated by the arrow. In FIG. 1, for example, the "leading" side of the carrier is to the right and the trailing side is to the left.

The carrier 10 has eight apertures 15*a*-15*h*, which in this embodiment are identical. The apertures are arranged in two rows, providing four ranks each with an aperture either side of a notional centreline C.

Each aperture (only one 15*a* is described in detail) is generally rectangular, oriented to extend longitudinally along one side of the carrier, and has a centre point 20*a*.

One of the shorter sides 25*a* of the aperture is a leading edge and the opposite side 30*a* is a trailing edge. The side 25*a* is generally straight. The side 30*a* is comprised of an arcuate tab 31*a* defined by two truncated circular/arcuate ear-like corner cut-outs 32*a*, 33*a* and faces the centre of the aperture. The tab 31*a* may act like a flap and in some embodiments "hinges" as the aperture is applied to a container. This means that the trailing edge tab/flap will naturally fold upwards as the carrier is moved down over a container; in effect the tab "wipes" down the container, which ensures that it maintains a upward inclination.

Outboard of the aperture 15*a* is a leading edge drive pin hole 35*a* and a trailing edge drive pin hole 40*a*. The holes are mutually longitudinally spaced and the aperture is located longitudinally between the holes (with no overlap i.e. the leading and trailing edges are longitudinally spaced from the respective leading and trailing drive pin holes). The holes 35*a*, 40*a* are positioned towards an outside edge 45 of the carrier.

The distance between the centres of the holes provides a notional midpoint. The centre point 20*a* of the aperture is offset with respect to the midpoint, in this embodiment being offset longitudinally towards the trailing drive pin hole 40*a*.

The centre point 20*a* of the aperture is also offset towards the longitudinal centre line C. In other words the aperture is not positioned centrally with respect to a point longitudinally between the centre line C and the outside edge 45.

Along the centre of the carrier alternating oval cut-outs 50 (for weight-saving) and diamond shape cut-outs 55 (for machine manipulation) are provided.

Approximately half way along the edge 45 a handle portion 60 is provided. Two finger grip tabs 64 are provided on the portion 60.

Figure 2:
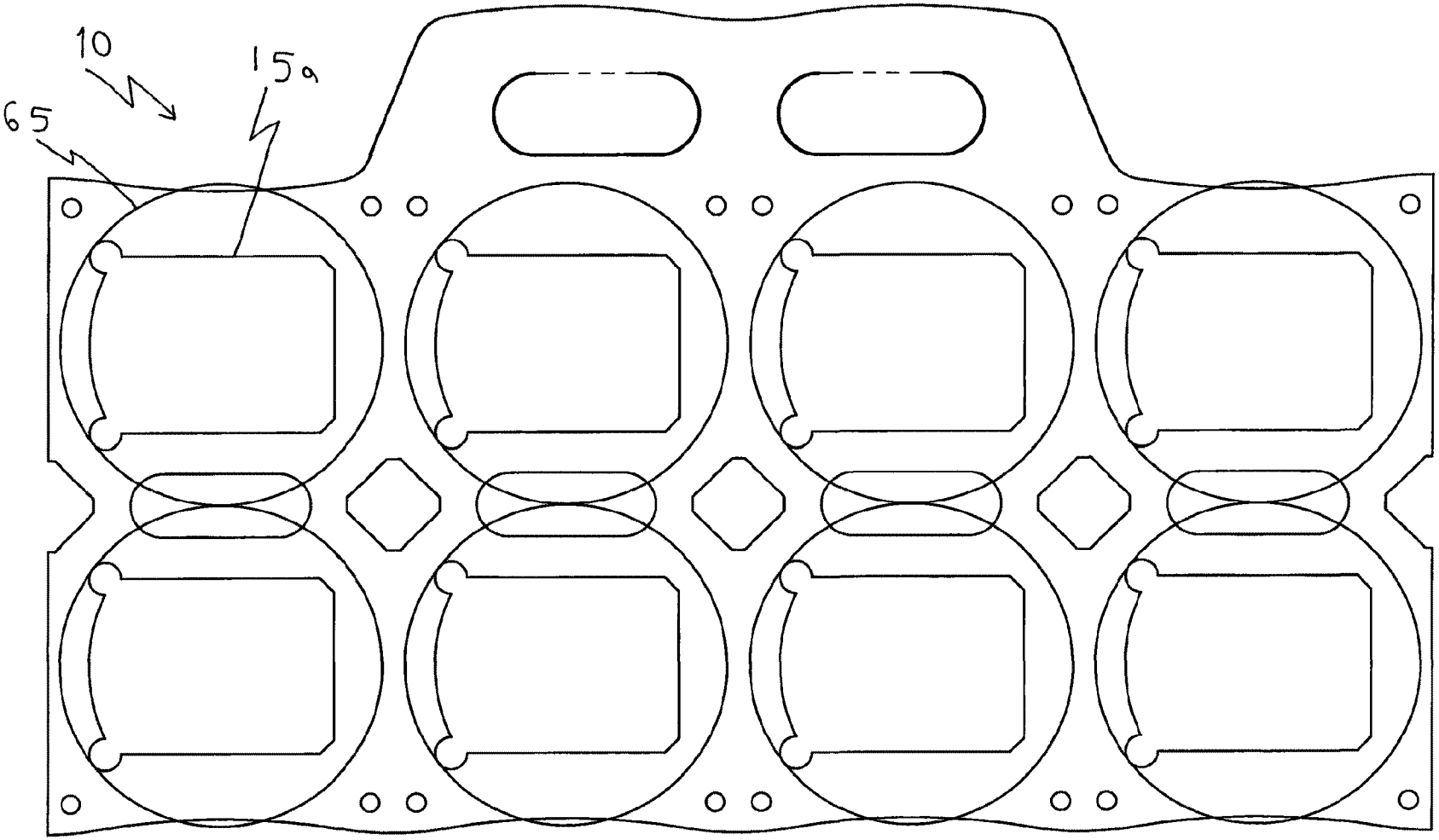
FIG. 2 illustrates a carrier with containers positioned below each aperture.

FIG. 2 shows the carrier 10 with containers 65 positioned below each aperture to show the relative dimensions. It will be noted that the diameter of the containers 65 is larger than the size of the apertures.

Figure 3:
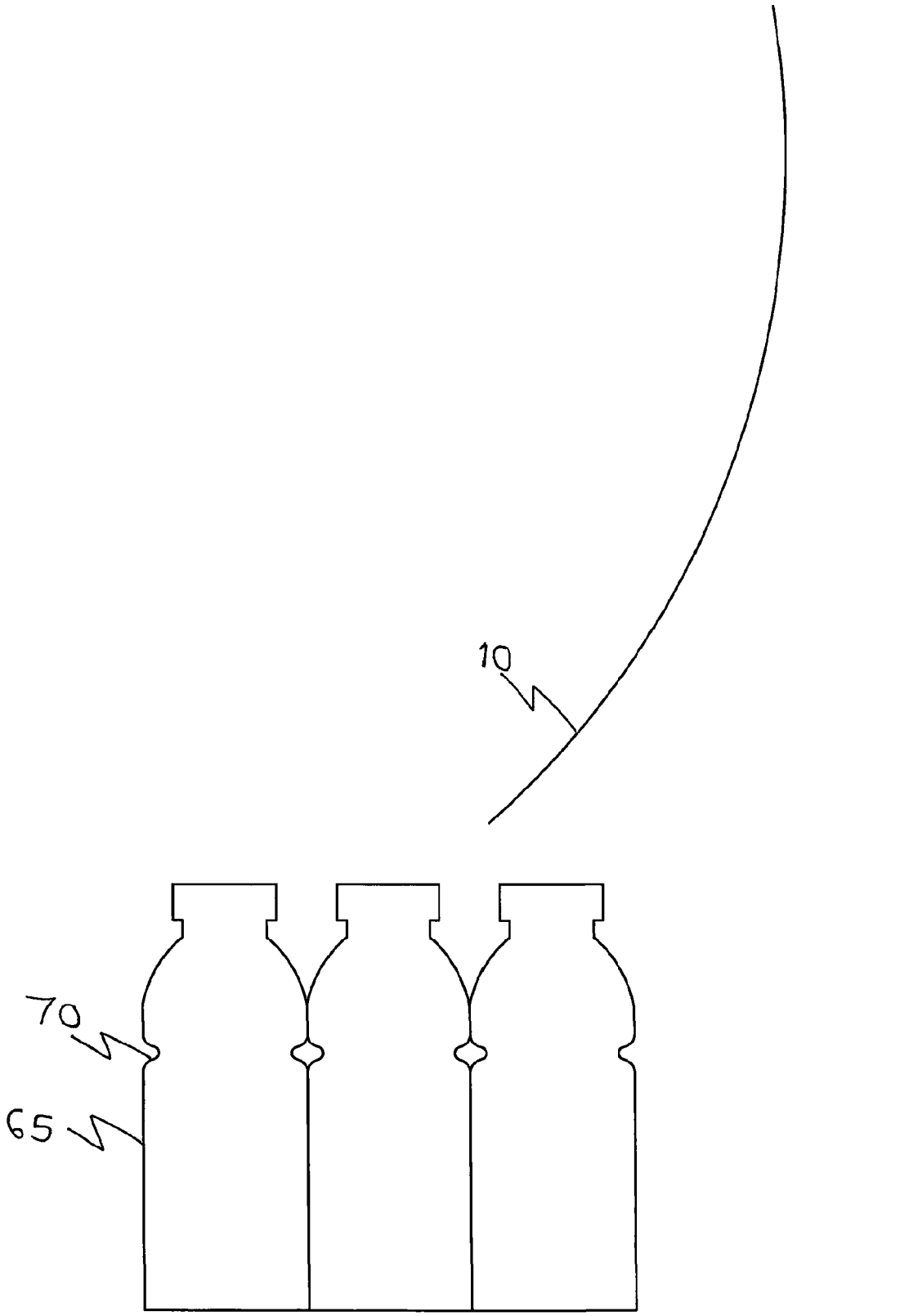
FIGS. 3 to 5 illustrate application of a carrier to a plurality of containers.
Figure 4:
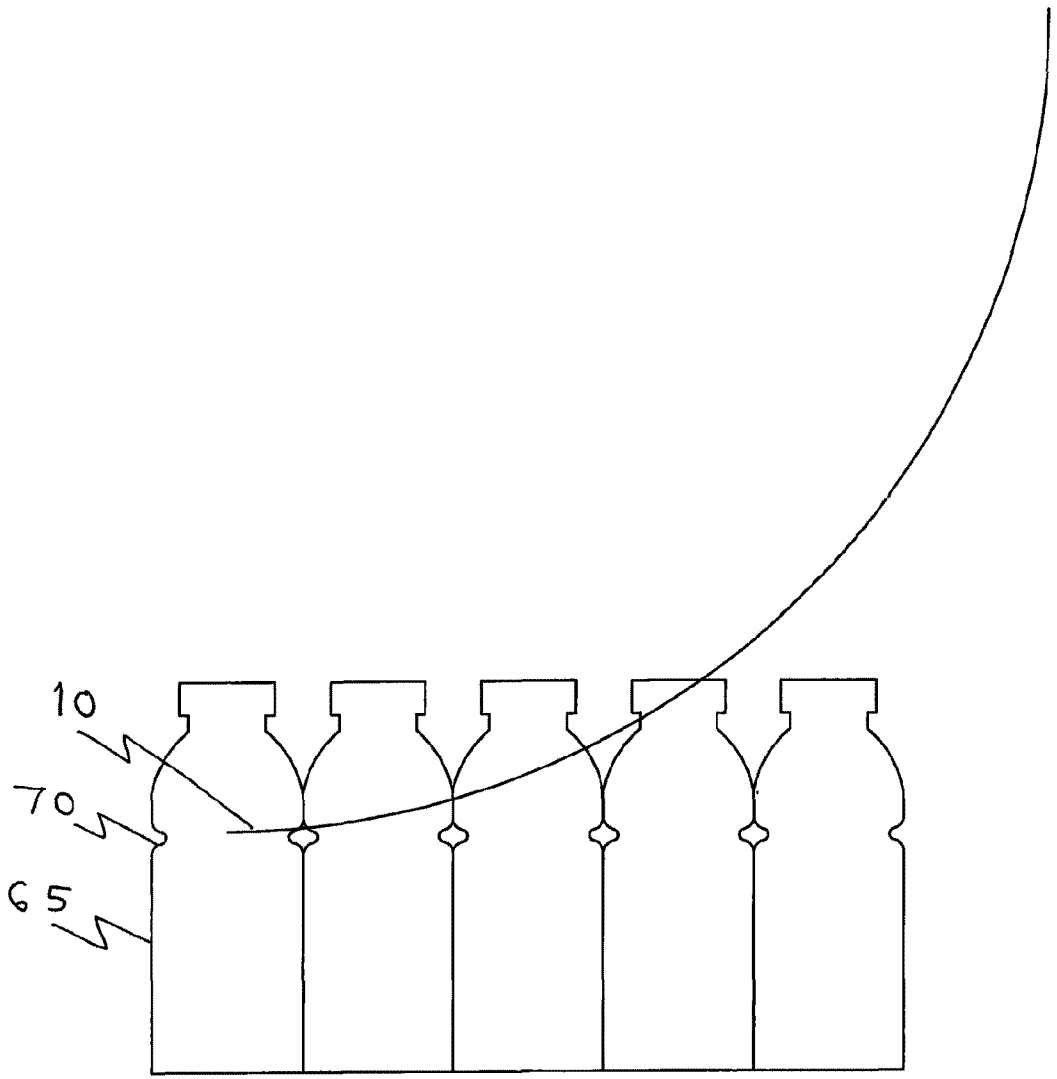
Figure 5:
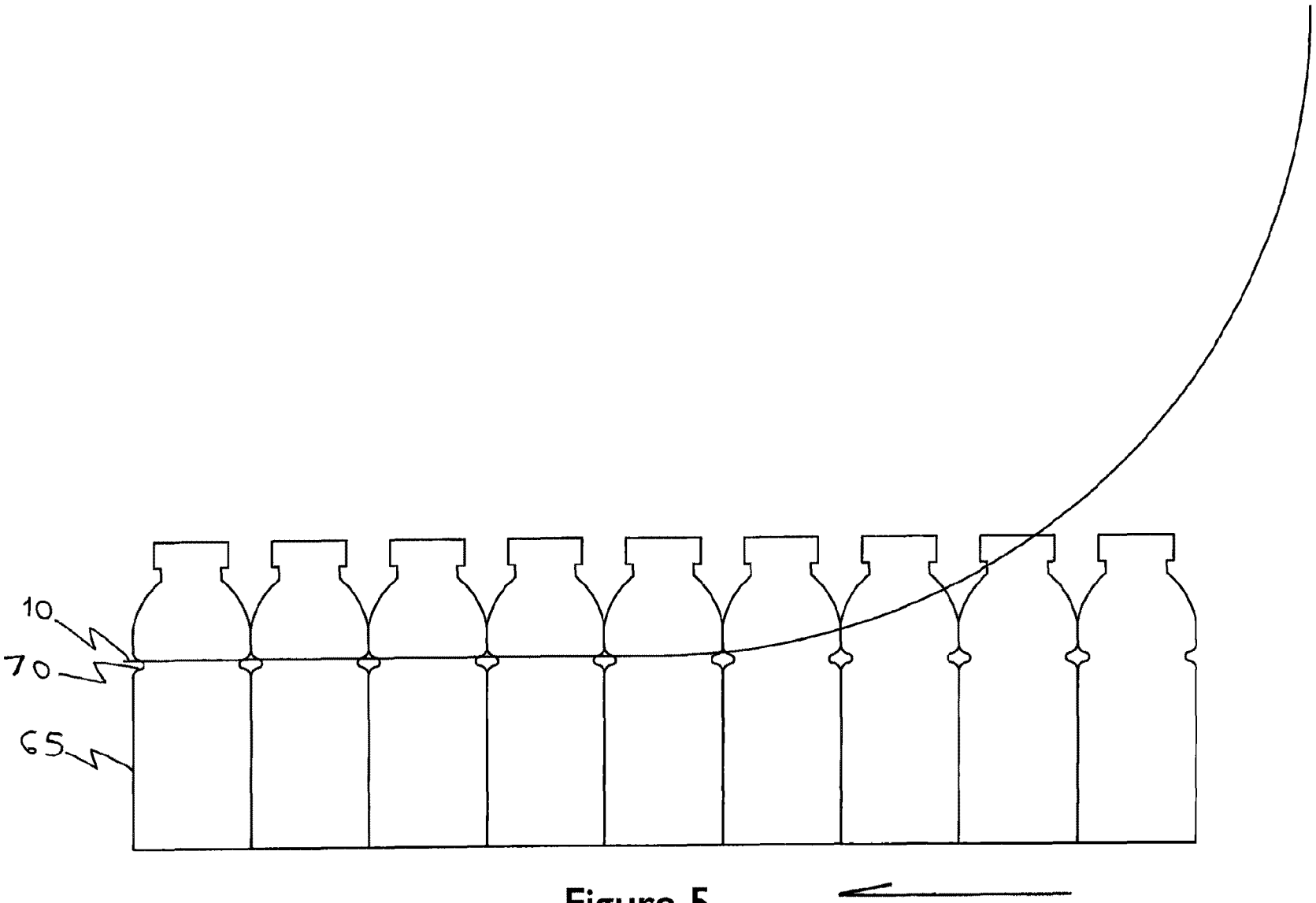
Figure 6A:
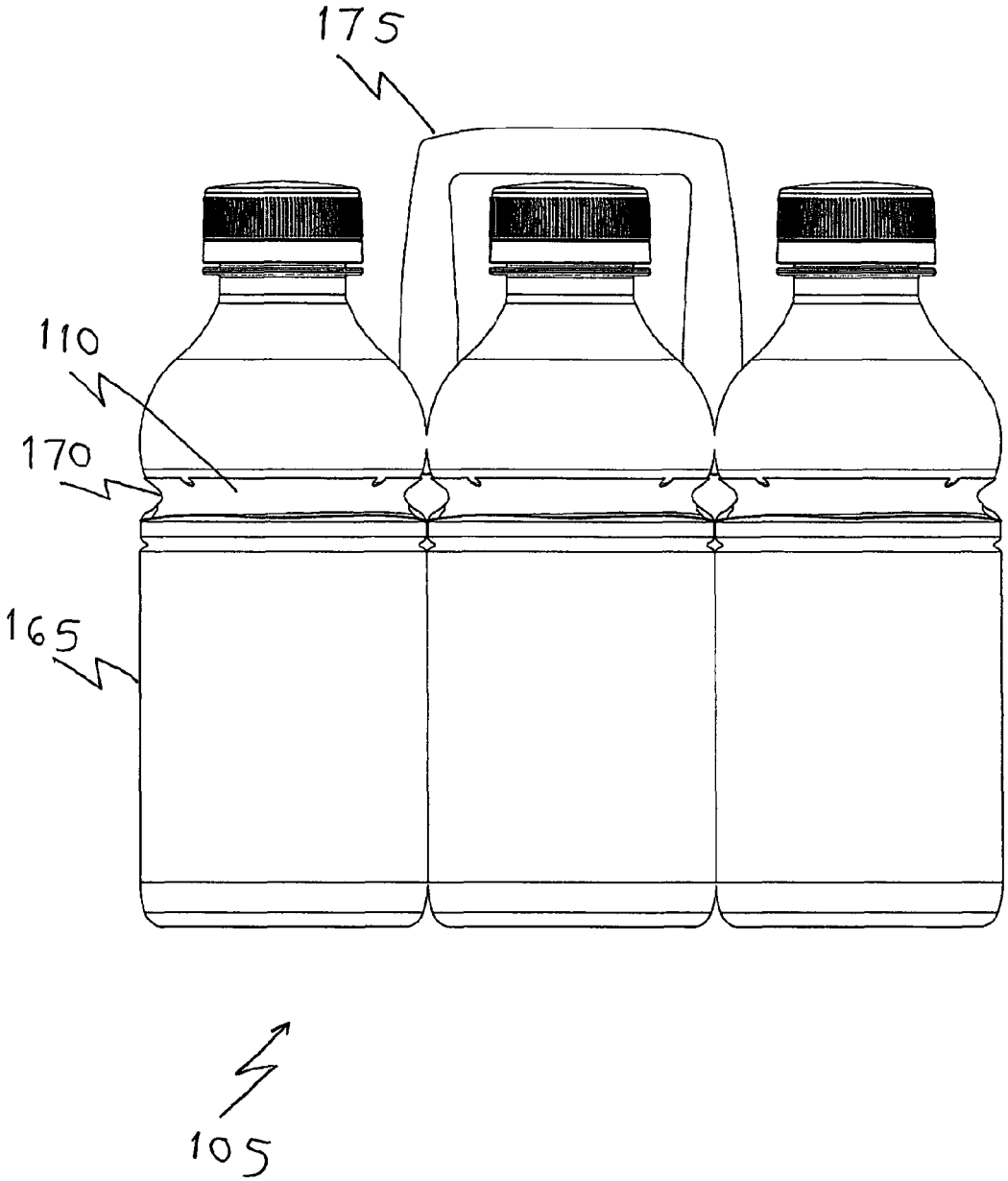
FIGS. 6A to 6D illustrate a multi-pack generally indicated comprising a carrier.
Figure 6B:
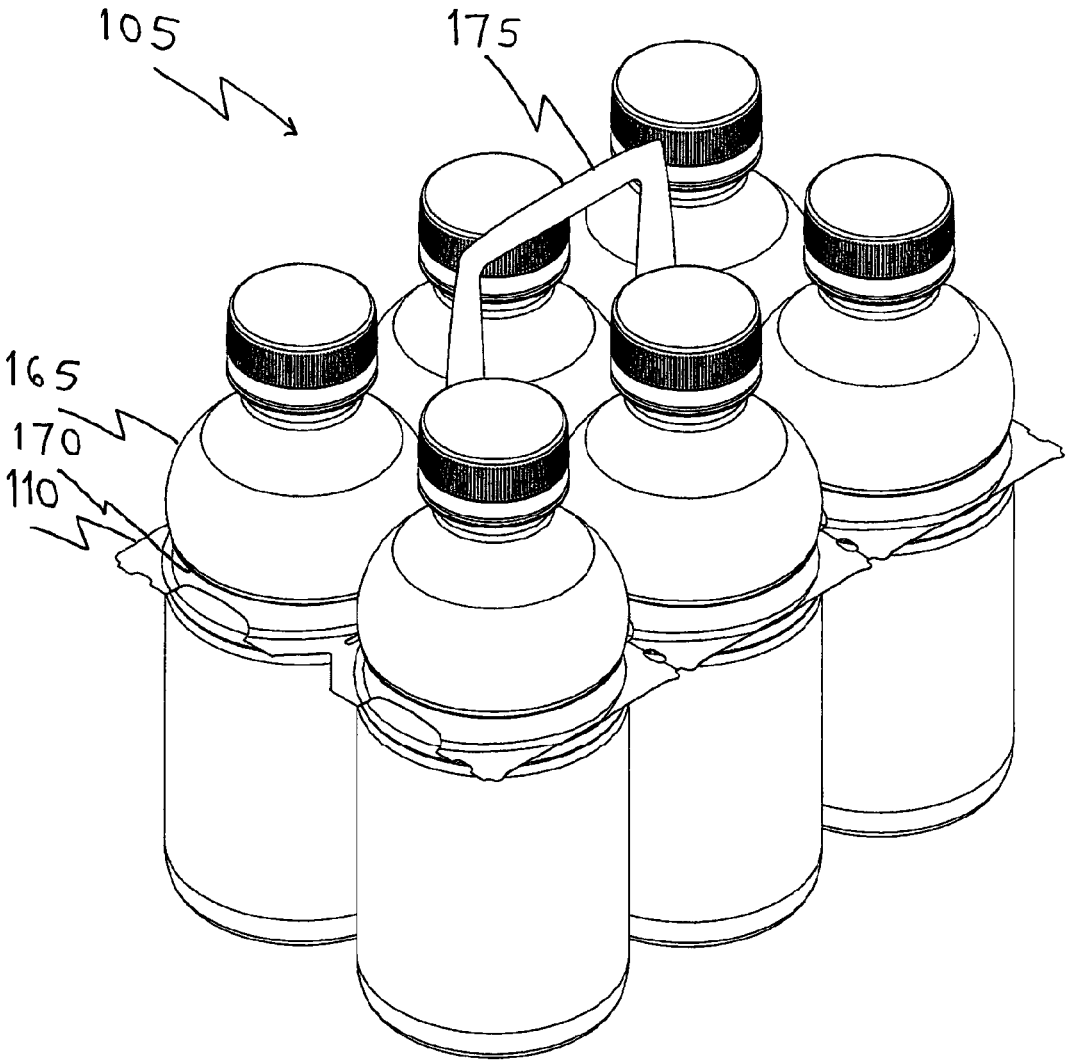
Figure 6C:
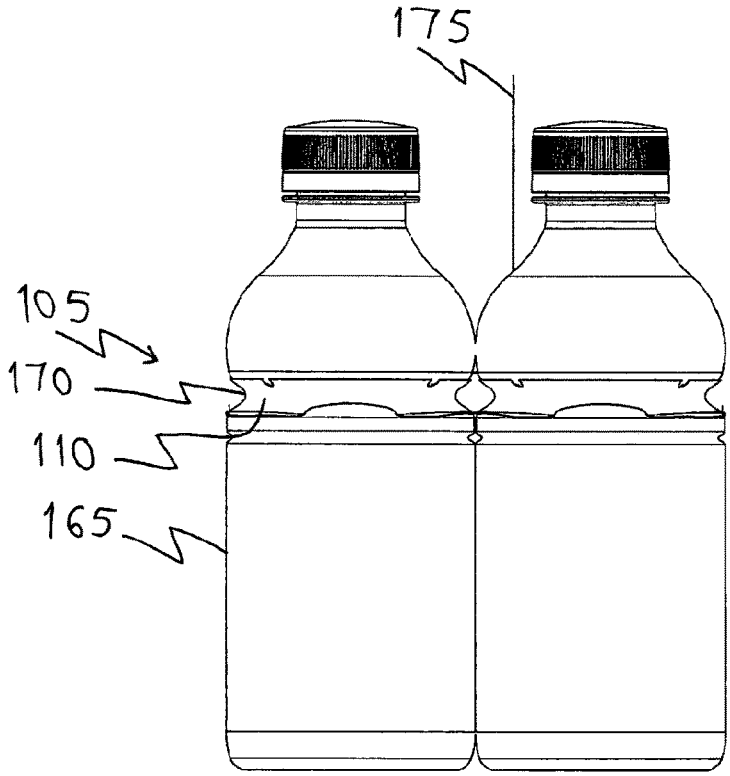
Figure 6D:
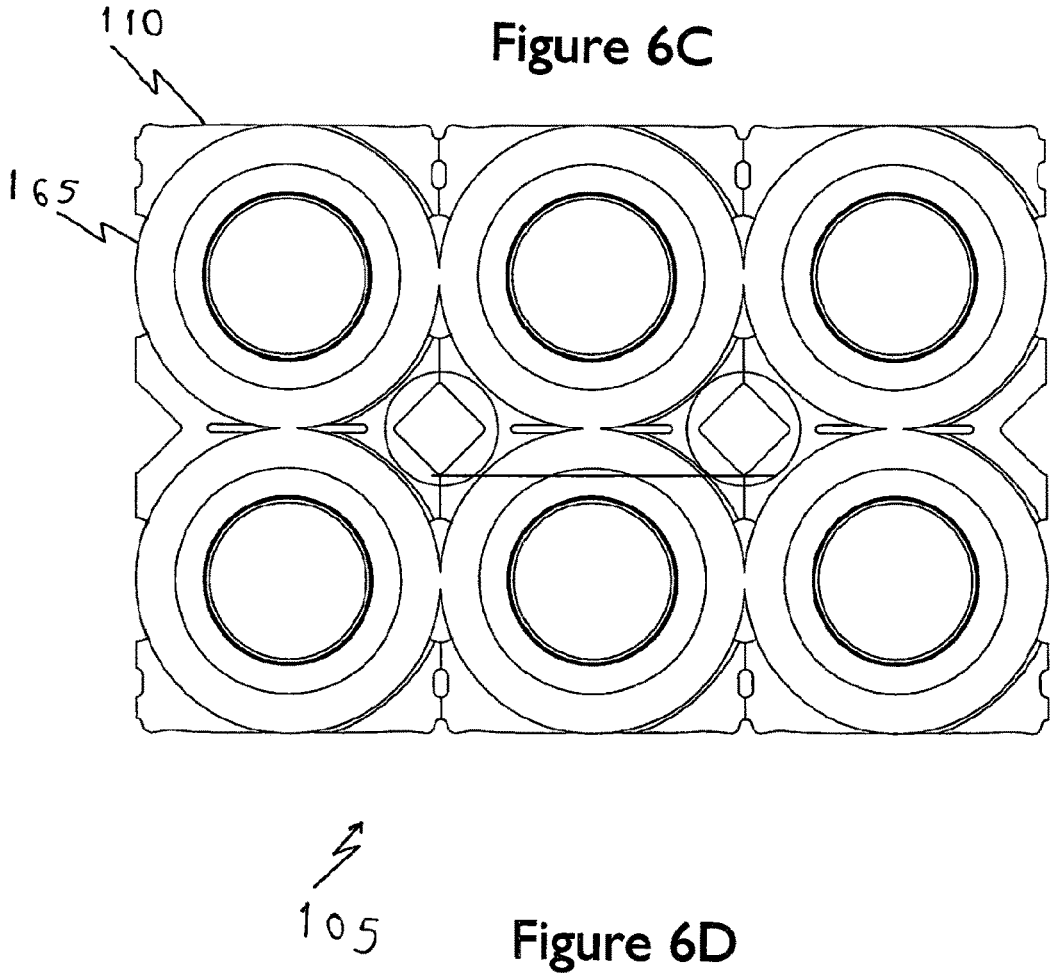

FIGS. 3 to 5 illustrate application of a carrier 10 to a plurality of containers 65. In this embodiment the carrier is configured to engage a recess 70 formed in the sidewall of the container.

The carrier is provided on a roll which is cut into sections after application. In this embodiment the cut line is between the leading edge of one aperture and the trailing edge of the next aperture.

The carrier is presented to the containers at a defined angle of incidence.

In FIG. 4 the aperture 15*a* has been moved down onto the container so that the trailing edge 30*a* engages the recess 70. The tab 31*a* will flex (helped by the cut-outs 32*a*, 33*a*) and this helps the aperture to stretch over the container and into the recess.

Because the aperture is displaced towards the trailing edge drive pin, this means that the aperture does not foul on the next container in line as it is applied. The trailing edge therefore engages the recess, then the aperture stretches around the container and finally the leading edge engages in the recess. This is a continuous roll-on process, as shown in FIG. 5.

FIGS. 6A to 6D show a multi-pack generally indicated 105 and comprising a carrier 110 formed according to an alternative embodiment which holds together (in this embodiment) six containers 165. The carrier apertures are shown engaged around the container recesses 170. A top handle 175 is provided, in this embodiment being a separate piece which is welded in position.

Figure 7:
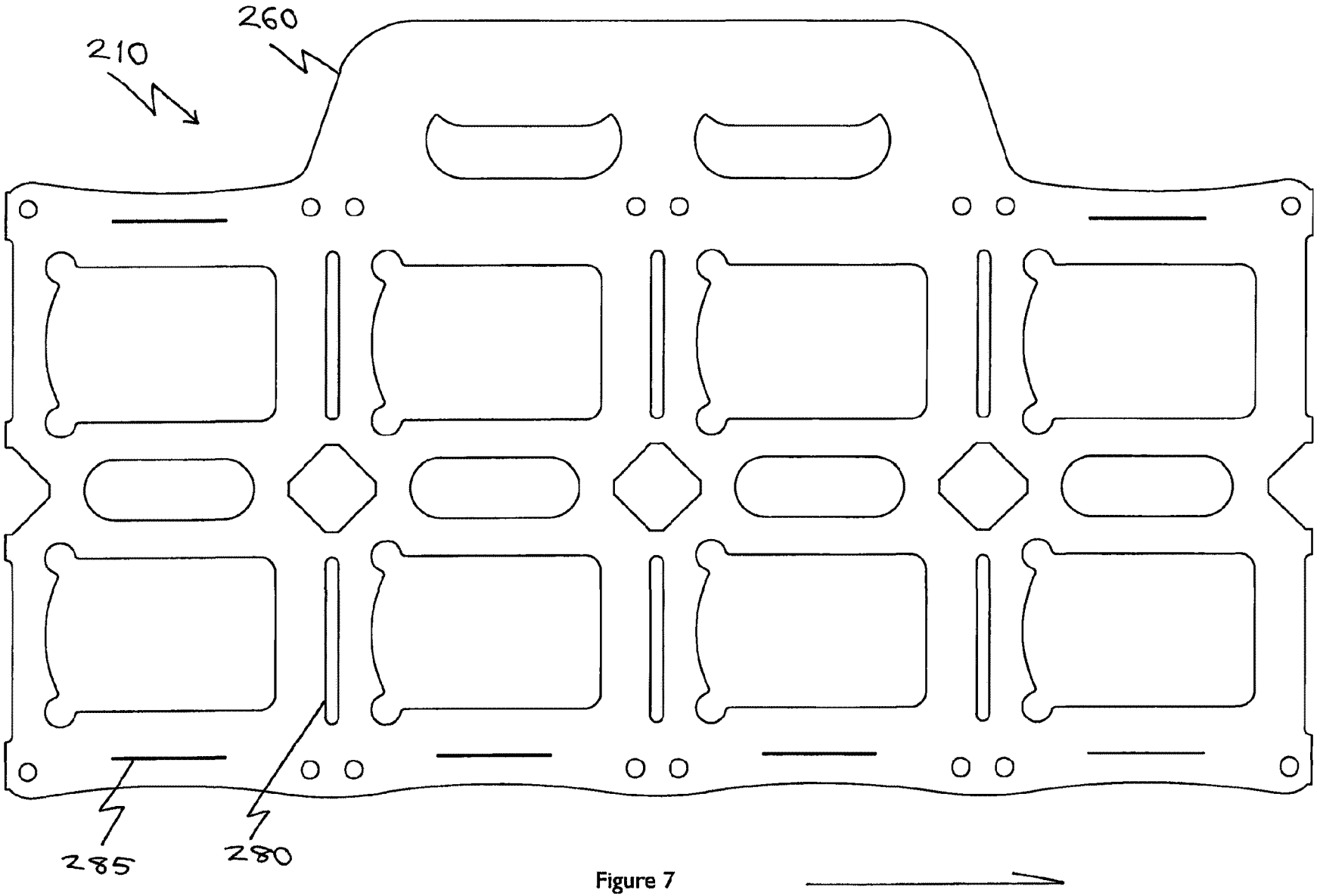
FIG. 7 illustrates a carrier.

FIG. 7 shows a carrier 210 formed according to a further embodiment. The carrier 210 is very similar to the carrier 10. In this embodiment longitudinally between each aperture a lateral slot 280 is provided. In addition, longitudinal slots 285 are provided alongside (outboard) each aperture. An integral side handle 260 is provided.

Figure 8:
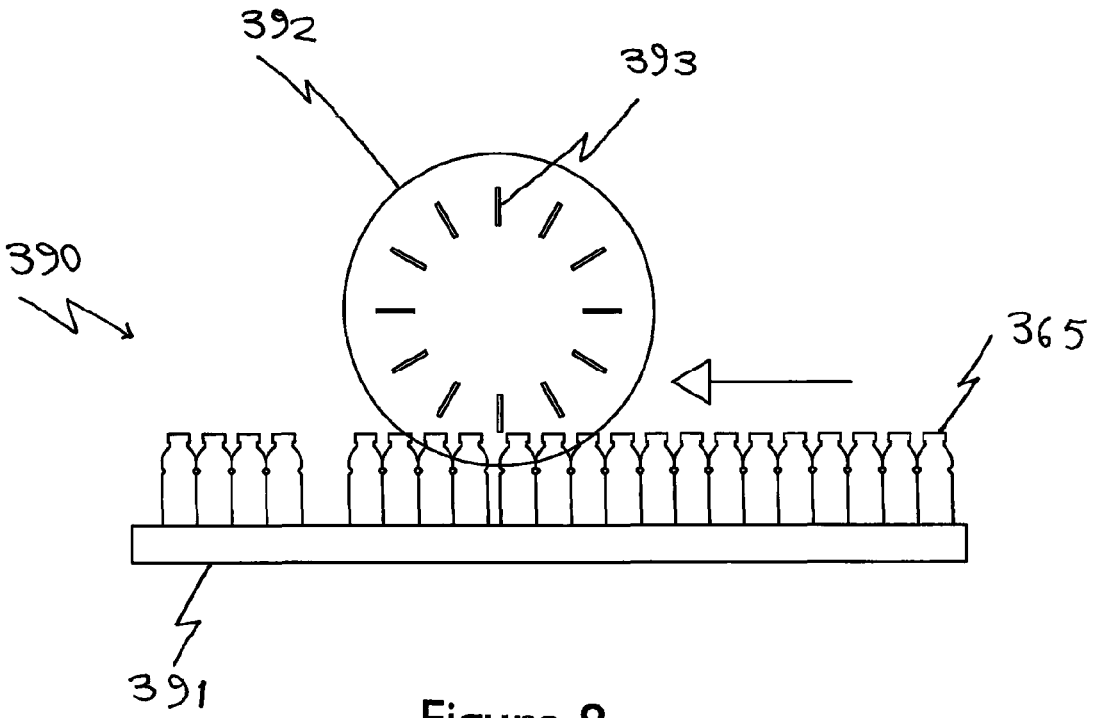
FIGS. 8 and 9 illustrate a carrier application system generally indicated.
Figure 9:
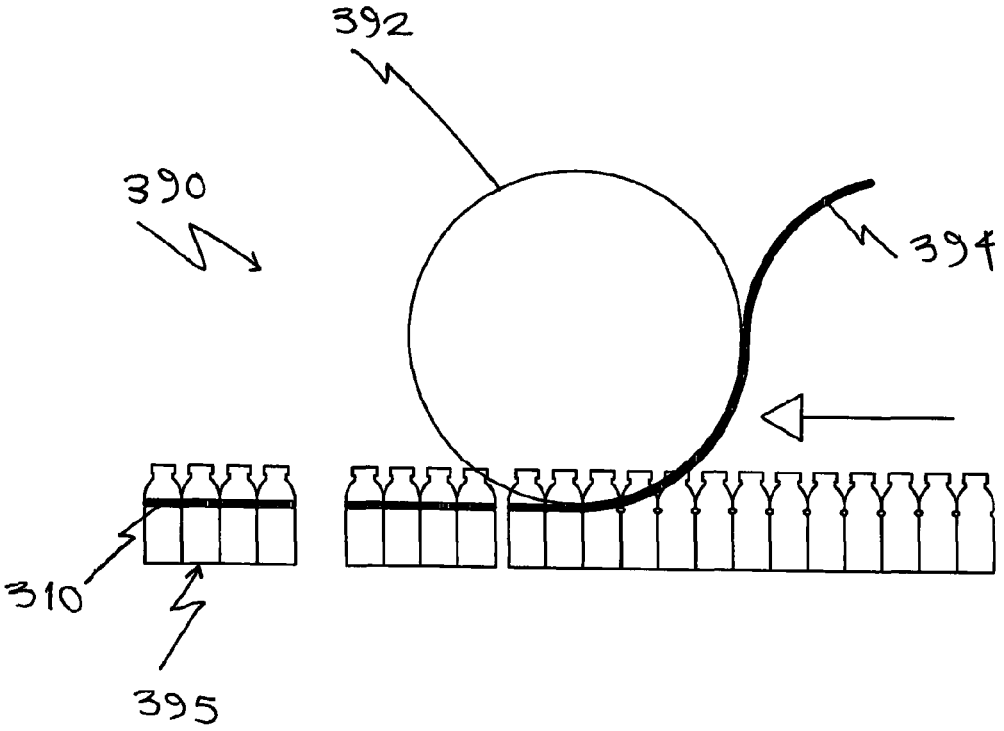

Referring now to FIGS. 8 and 9 there is shown a carrier application system generally indicated 390. The system 390 includes a linear conveyor 391, which in this embodiment transports containers 365 along a generally flat path. The system 390 further comprises a rotary application drum 392. The drum is positioned above the line of containers, although it will be noted that the diameter of the drum means that when passing under the drum, containers move inside the outer periphery. In this embodiment the drum 392 is provided with a plurality of internal cutting blades 393.

In use, and as illustrated in FIG. 9, the rotary drum 392 is fed with a continuous length of carrier stock 394. The stock is urged downwards and onto containers so that carrier stock apertures pass down the sides. The blades 393 are positioned at precise rotational points so that they engage the carrier stock between adjacent carriers 310 and divide off packs 395.

Figure 10:
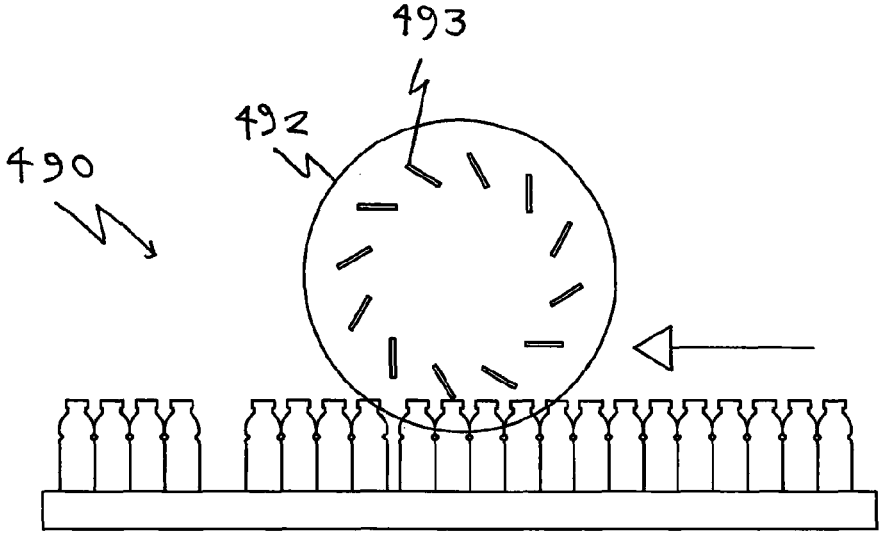
FIGS. 10 and 11 illustrate a carrier application system generally indicated.
Figure 11:
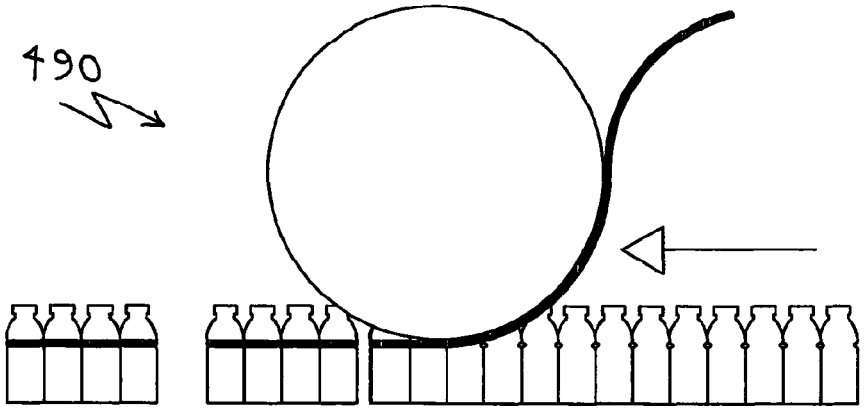

The system 490 of FIGS. 10 and 11 is similar to the system 390. In this embodiment the blades 493 in the drum 492 do not radiate from the centre point. Rather, they are inclined from notional radial lines.

This means that cuts made by the blades occur after at least the first rank of the trailing set of containers has been engaged by the next carrier. The cuts are therefore made between two containers that are engaged by a carrier.

Figure 12:
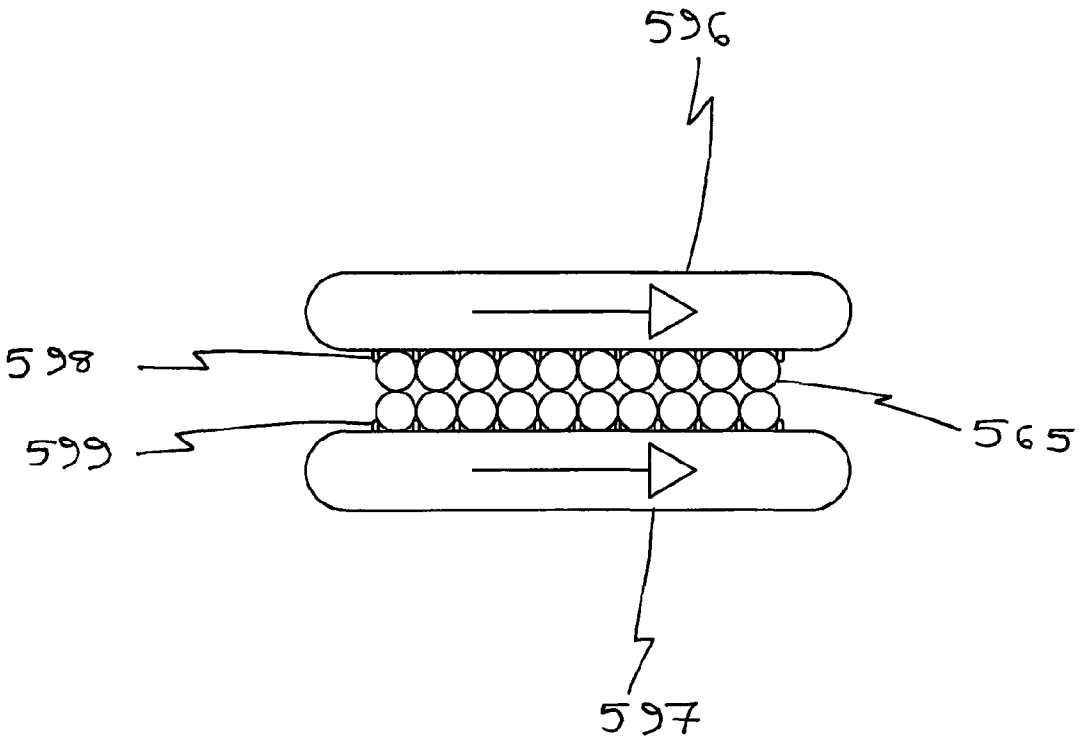
FIG. 12 illustrates an optional "caterpillar drive" system.

FIG. 12 shows an optional "caterpillar drive" system which comprises a pair of opposed tracks 596, 597 each having respective teeth 598, 599 positioned so that containers 565 are moved along and their position along a conveyor can be determined and controlled as they pass under a carrier applying drum. Such a drive system could be used in conjunction with any application system formed in accordance with the present invention.

Figure 13:
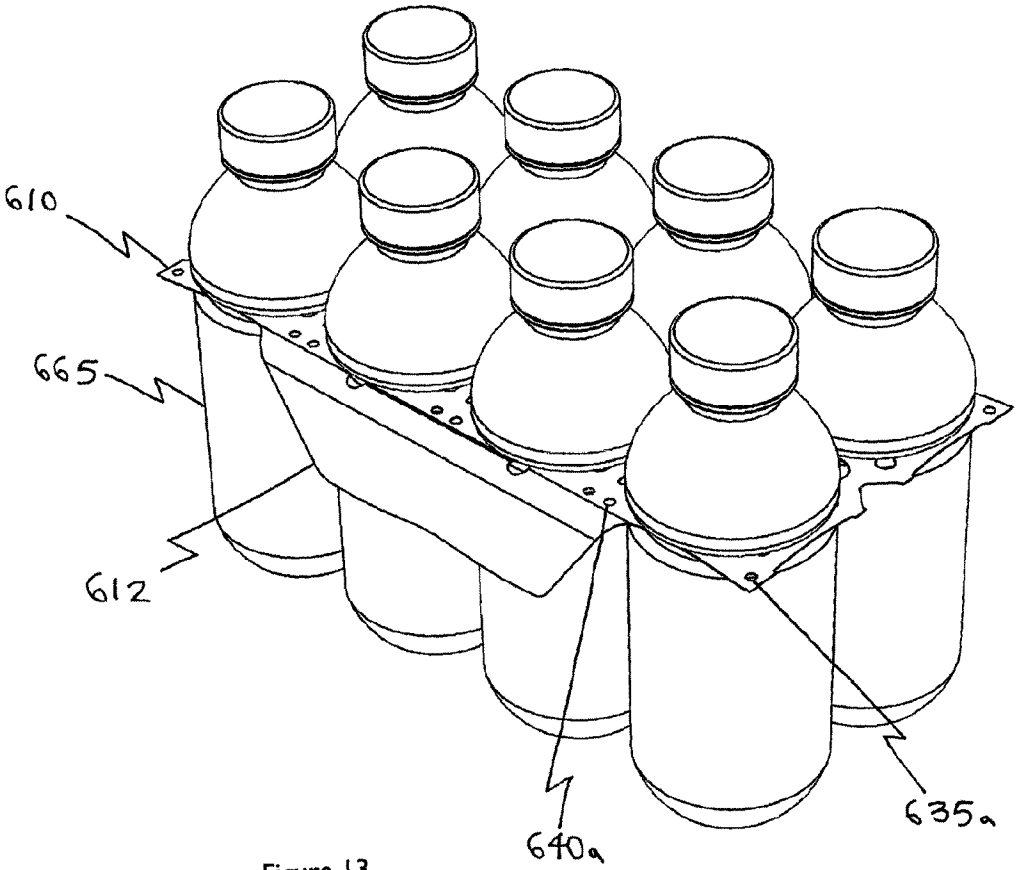
FIG. 13 illustrates containers unitised by a carrier.

FIG. 13 shows eight containers 665 that have been unitised by a carrier 610 formed in accordance with the present invention. In this embodiment, along one longitudinal side a merchandising panel 612 is provided.

Figure 14:
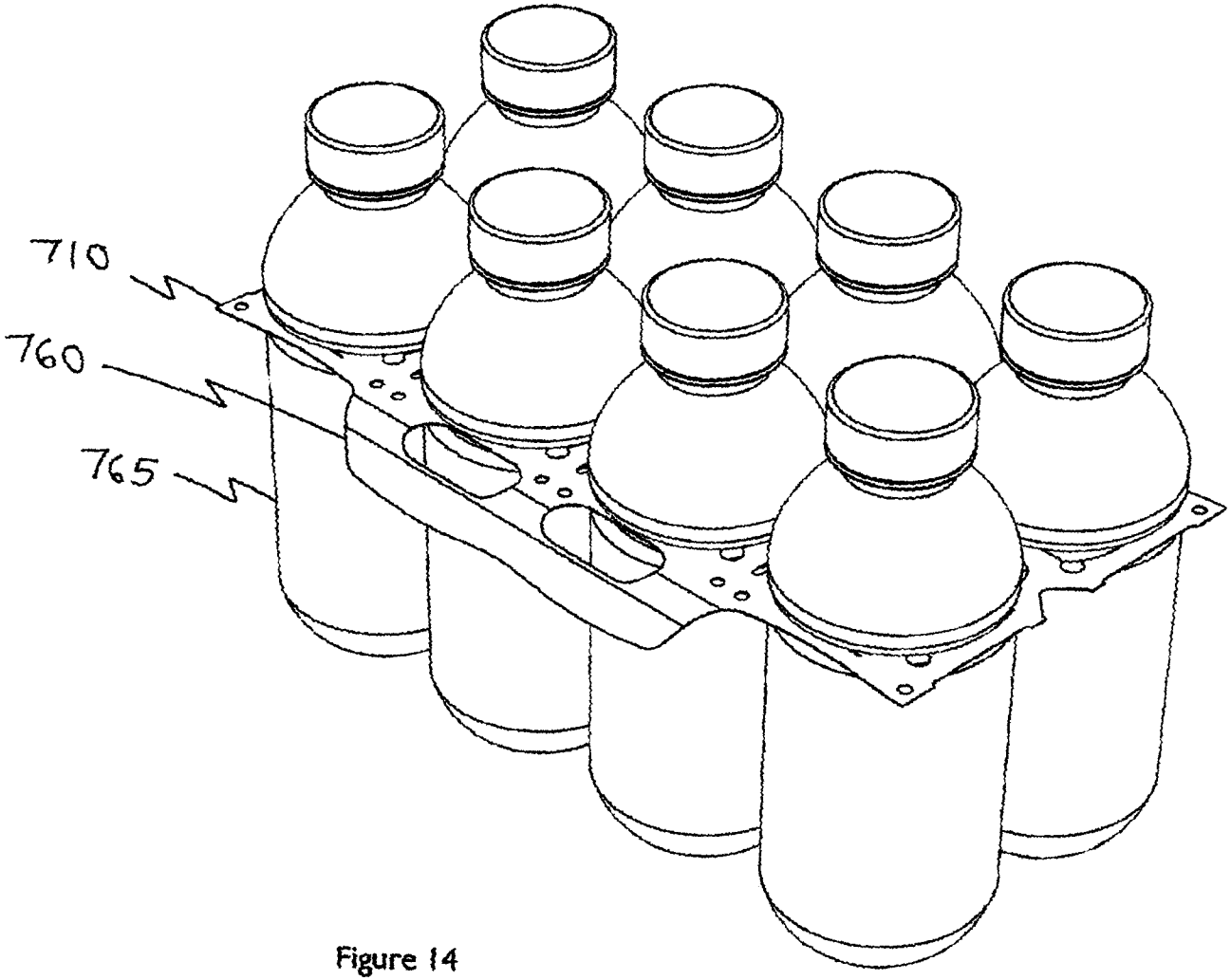
FIG. 14 illustrates a carrier.

FIG. 14 shows a carrier 710 similar to the carrier 610. In this embodiment an integral handle 760 is provided.

Figure 15:
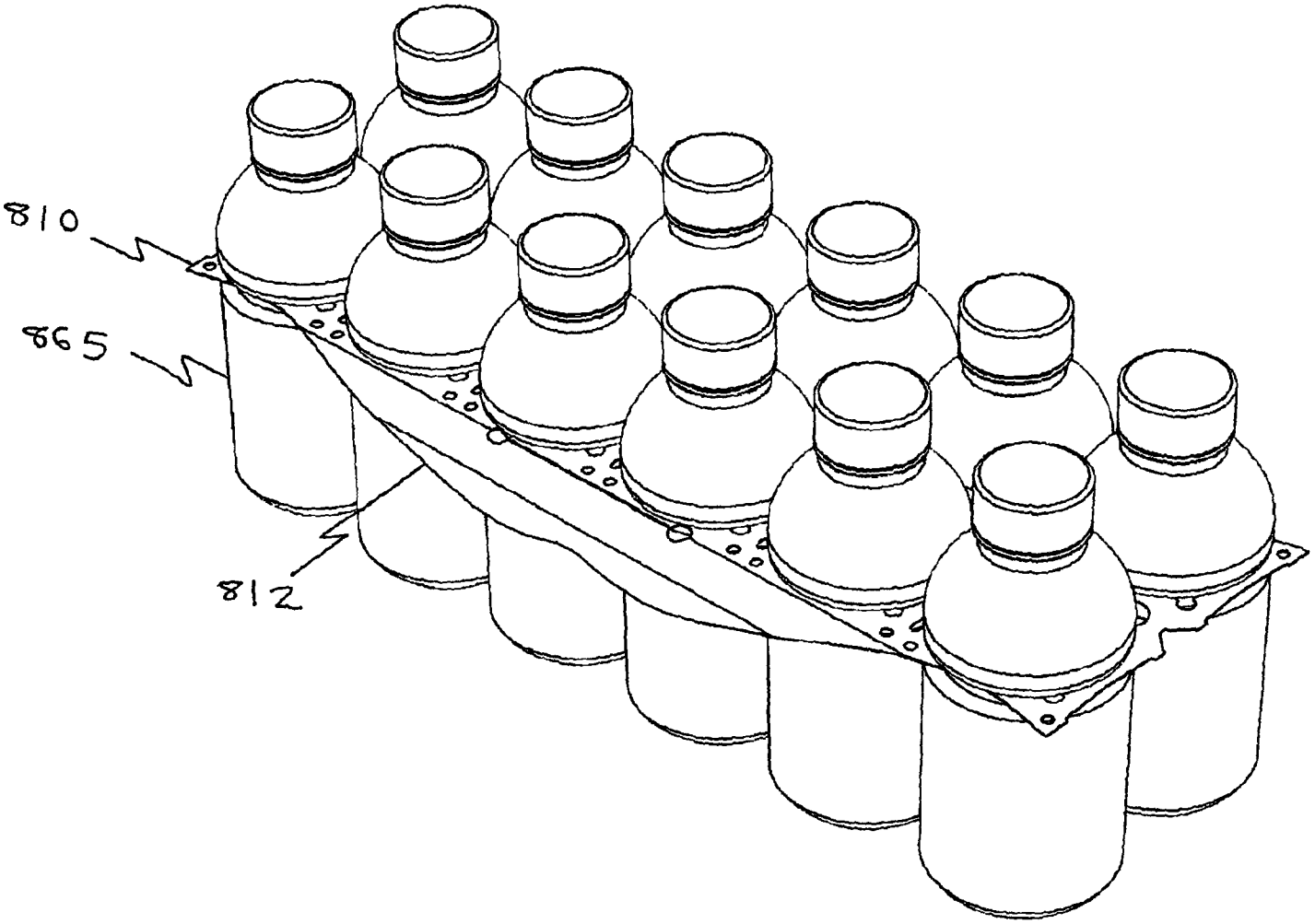
FIG. 15 illustrates containers unitized by a carrier.

FIG. 15 shows twelve containers 865 that have been unitised by a carrier 810 formed in accordance with the present invention. In this embodiment, along one longitudinal side a merchandising panel 812 is provided.

Figure 16:
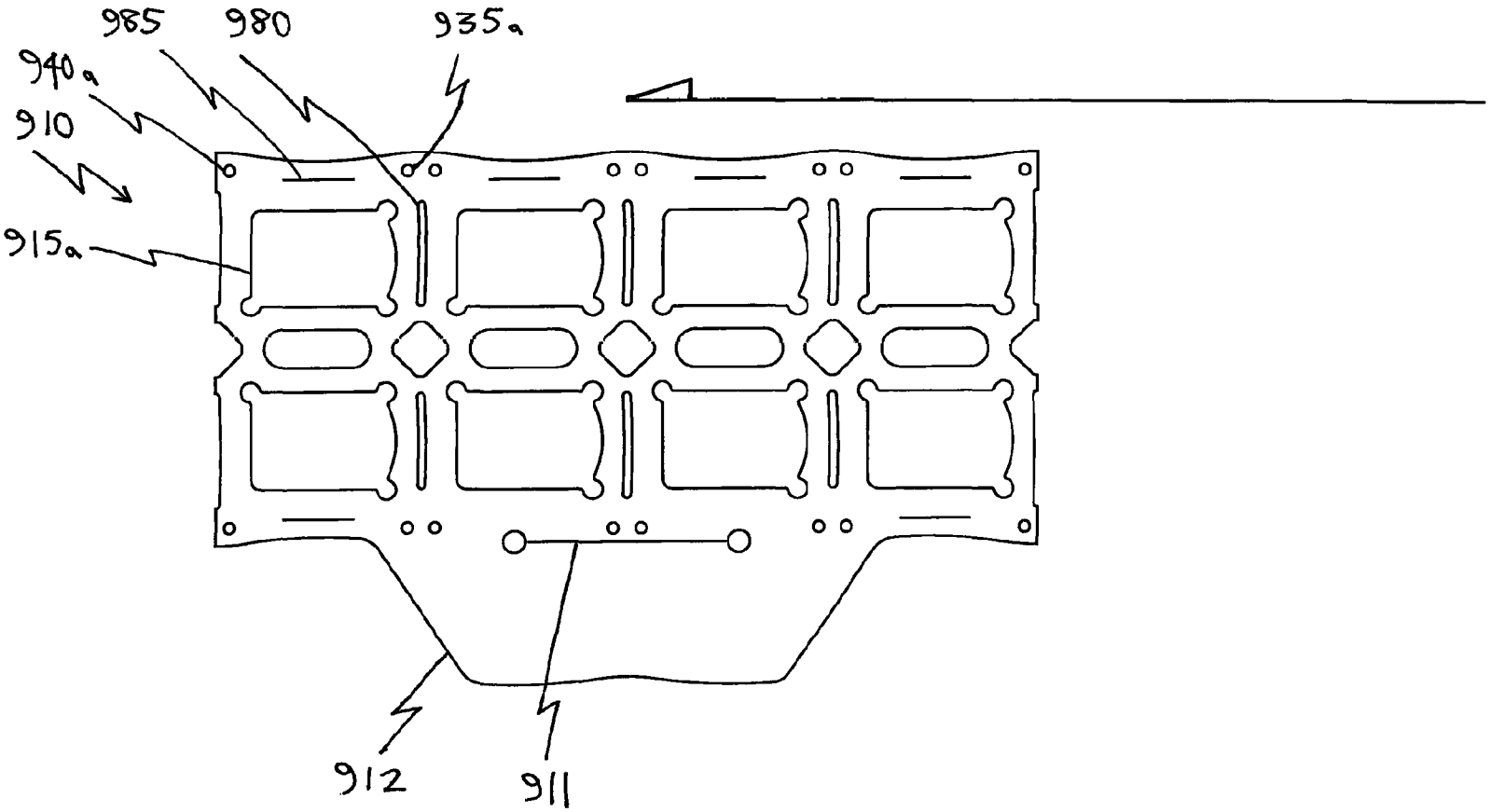
FIG. 16 illustrates a carrier.

FIG. 16 shows a carrier 910 formed according to a further embodiment. In this embodiment a promotional panel 912 is provided outboard of a handle slot 911. Lateral slots 980 are provided and positioned between each successive aperture. It will be noted that in this embodiment the slots are slightly curved, which improves rotary die cutting manufacture. In use the slots 980 isolate the "bands" between successive apertures i.e. the material that fits around containers; they also help to ensure that the bands are correctly orientated (in this embodiment the preference is for the bands to sit inclined inwardly and upwardly).

Figure 17:
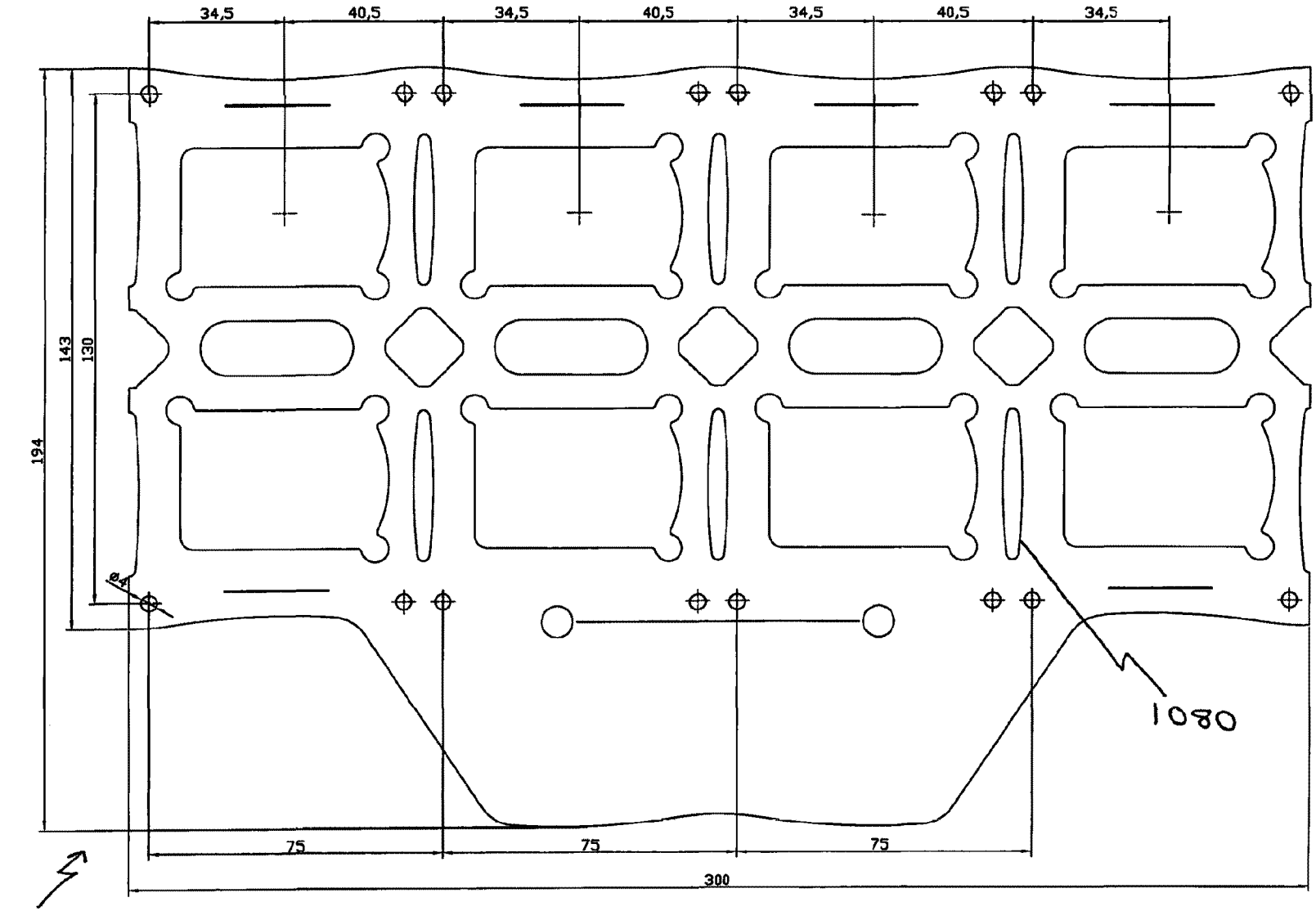
FIG. 17 illustrates a carrier.

FIG. 17 shows a carrier 1010 which is similar to the carrier 910. In this embodiment the lateral slots 1080 are generally elliptical. Dimensions are shown and in some embodiments a carrier formed substantially to the dimensions may be provided.

Figure 18:
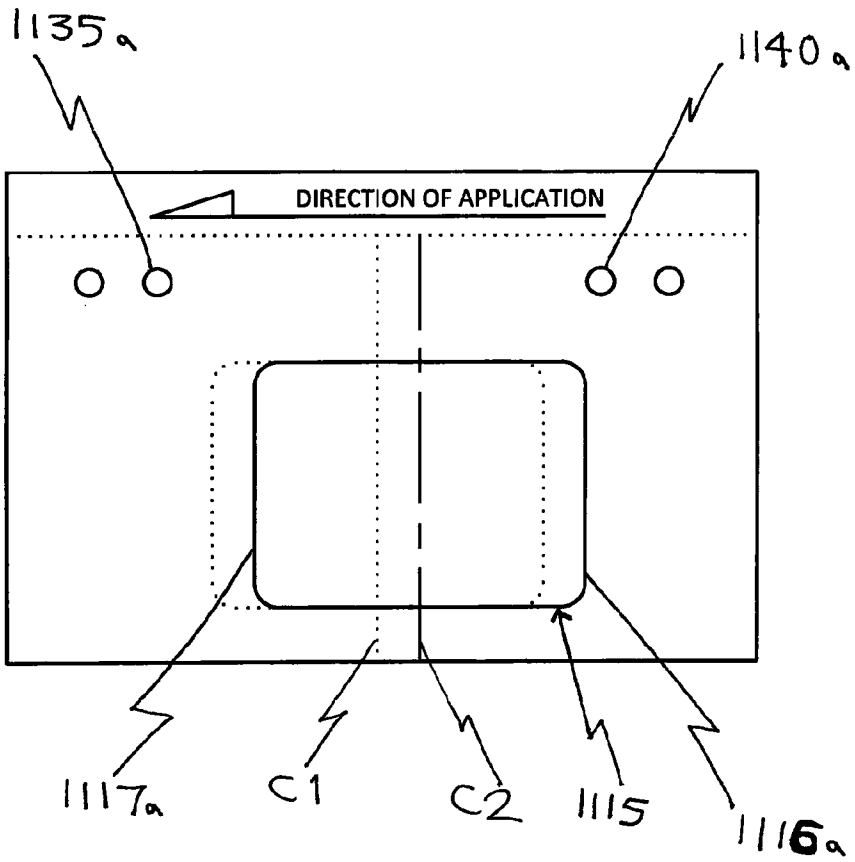
FIG. 18 illustrates an "offset aperture" principal.
Figure 19:
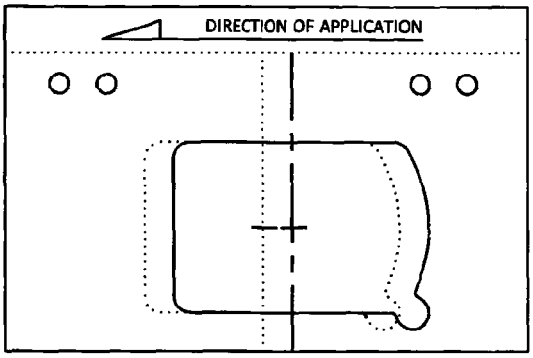
FIGS. 19 to 22 illustrate apertures with various truncated circular apertures.
Figure 20:
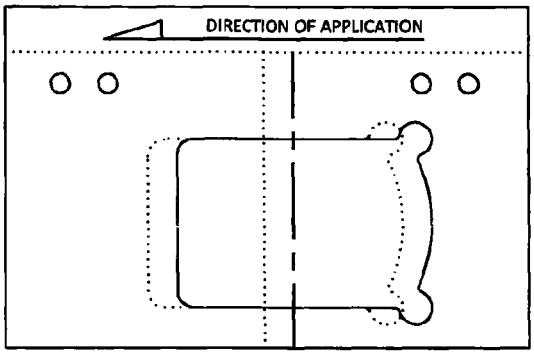
Figure 21:
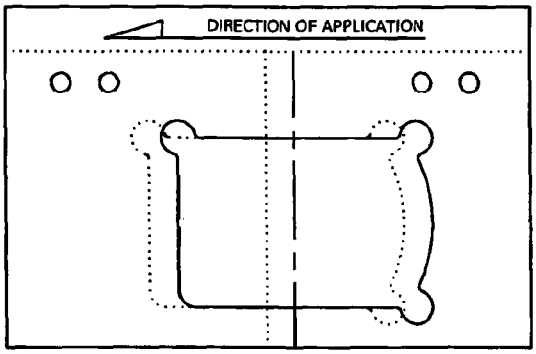
Figure 22:
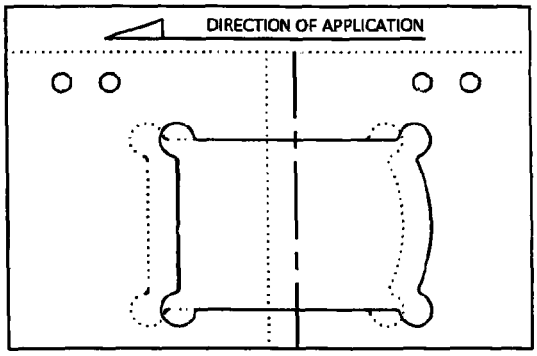
Figure 23:
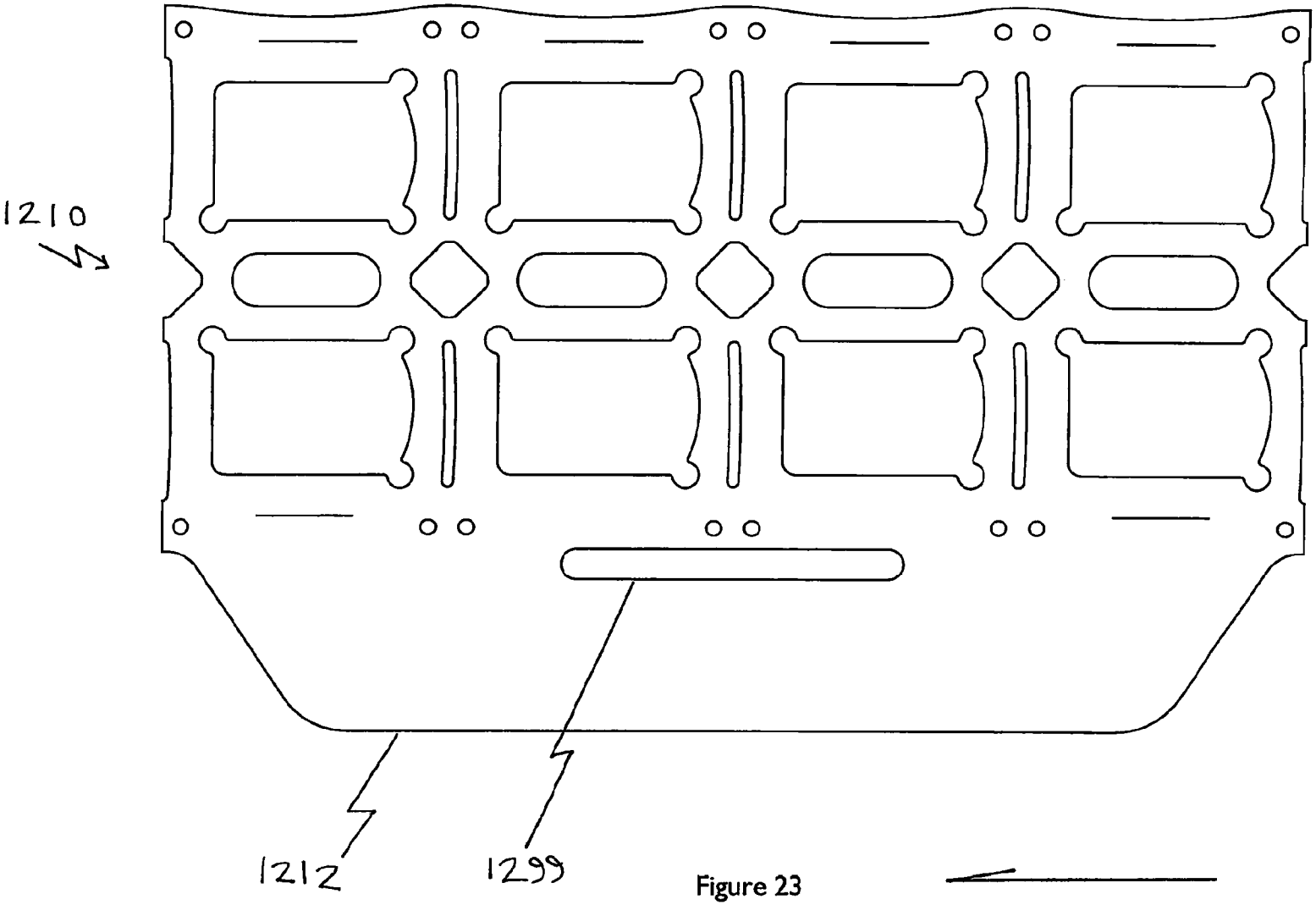
FIGS. 23 to 26 illustrate container carriers.
Figure 24:
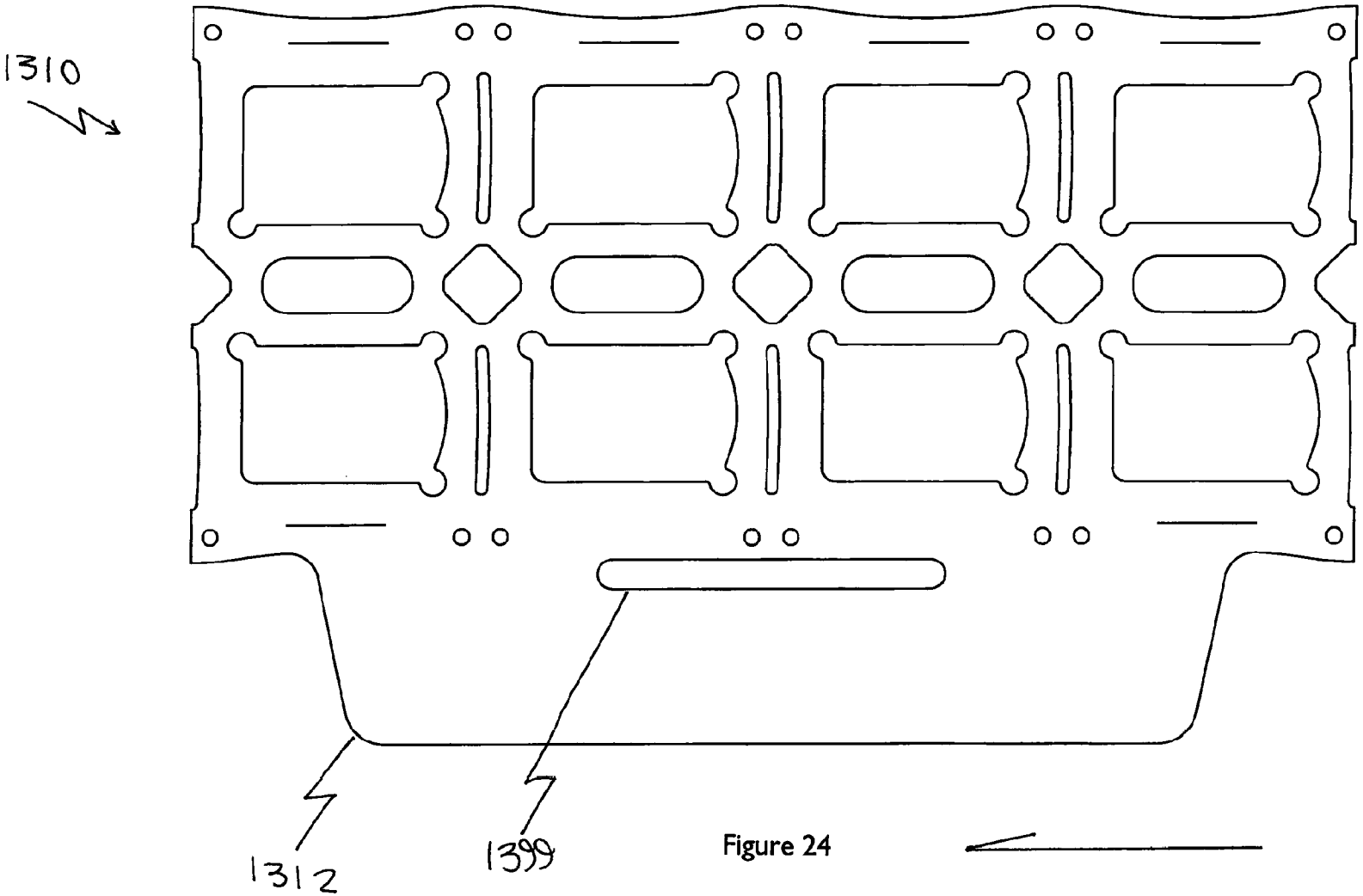
Figure 25:
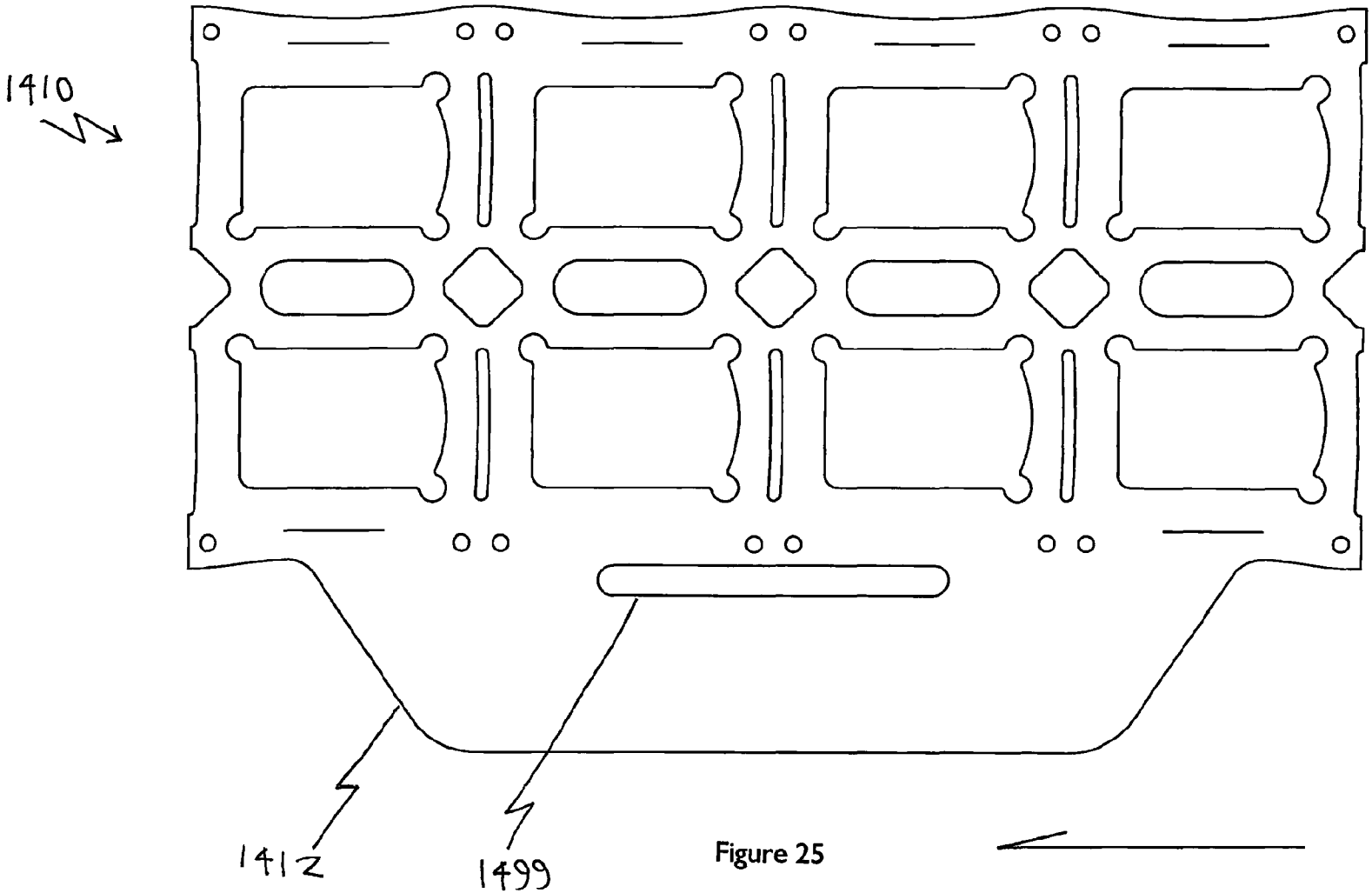
Figure 26:
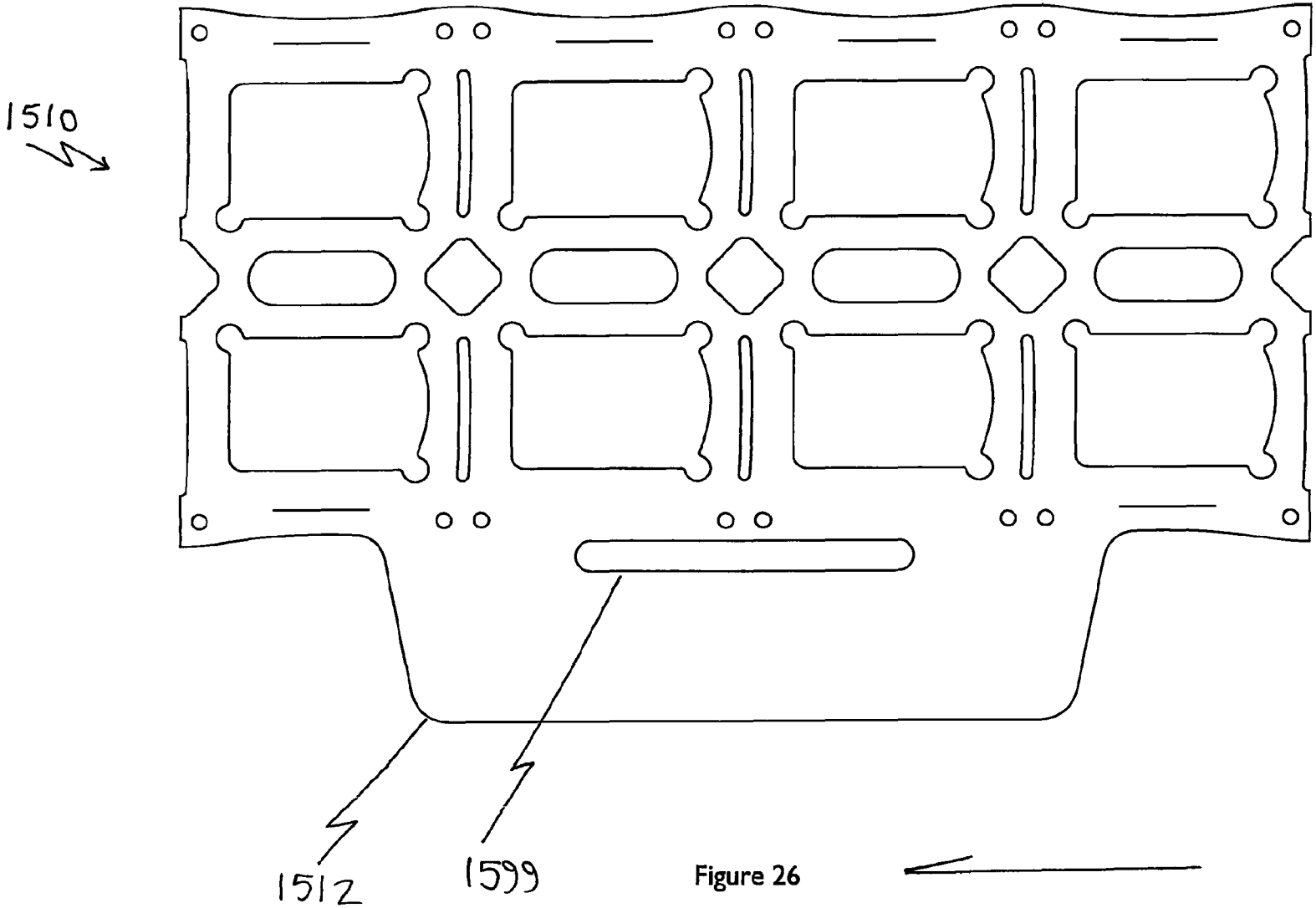

FIG. 18 illustrates an "offset aperture" principle of the present invention. In the embodiment shown in FIG. 18 a single generally curved rectangular aperture is shown. The direction of application is shown e.g. in the case that a drum is rotating clockwise and the containers move from right to left. This means that the leading drive pin (i.e. the pin first engaged by the drum) for this aperture is to the left (marked as 1135*a*) and the trailing drive pin is to the right (marked as 1140*a*). This also means that the leading edge of the aperture (i.e. the edge that first passes over and down onto the container) is to the left (marked as 1117*a*) and the trailing edge of the aperture is to the right (marked as 1116*a*). The centreline between the leading and trailing drive pins is marked as dotted line C1. It can be seen that the centreline C2 of the aperture is shifted towards the trailing pin (i.e. to the right). In use this means that as the carrier is clockwise rotated/rolled down onto a container (with the container moving on a conveyor from right to left) the trailing edge 1116*a* is less likely to foul on the top of the container before it starts to "wipe" down the side of the container.

In FIGS. 19 to 22 apertures with one, two, three and four truncated circular apertures are shown. In each case the offset aperture principle is applied. A curved edge of the aperture is on the trailing edge, which is also the direction in which the aperture is offset.

FIGS. 23 to 26 show container carriers 1210, 1310, 1410, 1510 formed according to further embodiments. In each case a merchandising/display panel 1212, 1312, 1412, 1512 is provided along one side and a single oval handle cut-out 1299, 1399, 1499, 1599 is provided.

The present inventions can be embodied in other specific apparatus and/or methods. The described embodiments are to be considered in all respects as illustrative and not restrictive. In particular, the scope of the invention is indicated by the appended claims rather than by the description and figures herein. All changes that come within the meaning and range of equivalency of the claims are to be embraced within their scope.

The invention claimed is:

1. A carrier having a plurality of apertures for holding a plurality of containers together, the carrier having mutually spaced drive pin holes distributed along the carrier in a longitudinal direction, the longitudinal direction corresponding to an axis of the carrier, each aperture is positioned in the longitudinal direction between successive drive pin holes, each aperture has a centre which is offset in the longitudinal direction from a mid-point between successive drive pin holes, the carrier having a leading drive pin hole and a trailing drive pin hole associated with each aperture, the drive pin holes being spaced in the longitudinal direction, in which each aperture centre is offset towards a respective trailing drive pin hole.

2. A carrier as claimed in claim 1, in which the carrier comprises two parallel rows of apertures.

3. A carrier as claimed in claim 2, in which the carrier has a centreline between the rows and in which the aperture centres are offset towards the centreline.

4. A carrier as claimed in claim 1, in which the apertures are oriented with a longer dimension extending along the the longitudinal direction.

5. A carrier as claimed in claim 1, in which each aperture has a geometry comprising one or more tabs facing the centre.

6. A carrier as claimed in claim 5, in which each tab is defined by truncated circular cut-outs.

7. A carrier as claimed in claim 1, in which a handle portion is provided.

8. A carrier as claimed in claim 1, in which at least one or more of side or end panels are provided.

9. A carrier as claimed in claim 1, in which the aperture centres are offset from the mid-point of the driving pin holes by an amount in the range of 2% to 50%.

10. A carrier as claimed in claim 1, in which the drive pin holes are provided towards an edge of the carrier that extends along the longitudinal direction.

11. A carrier as claimed in claim 1, having the apertures configured to fit tightly around a relief formed in a bottle sidewall.

12. A multi container pack comprising a plurality of containers held together by a carrier as claimed in claim 1.

13. A carrier having a plurality of apertures for holding a plurality of containers together, the carrier having mutually spaced drive pins holes distributed in a longitudinal direction of the carrier, the longitudinal direction corresponding to an axis of the carrier, each respective aperture is positioned in the longitudinal direction between successive drive pin holes, each aperture has a centre which is offset in the longitudinal direction from a mid-point between successive drive pin holes, the carrier having a leading drive pin hole and a trailing drive pin hole associated with each aperture, the drive pin holes being spaced in the longitudinal direction, in which each aperture centre is offset in the longitudinal direction towards a respective leading drive pin hole.

14. A carrier having a plurality of container apertures having arranged in two aperture rows for holding a plurality of containers together, all of the container apertures a generally quadrilateral shape, the carrier has a centreline and the carrier has two outside edges extending in a longitudinal direction, said outside edges being on either side of the centreline, in which positioned adjacent each of said outside edges is a respective row of drive pin holes extending in the longitudinal direction, all of said drive pin holes in each said row of drive pin holes being arranged as a linear array, and in which between the container aperture rows are provided one or more manipulation apertures or weight saving cutouts.

* * * * *